US010344474B2

(12) United States Patent
Dinmore et al.

(10) Patent No.: US 10,344,474 B2
(45) Date of Patent: Jul. 9, 2019

(54) STAY-IN-PLACE FORMS AND METHODS AND EQUIPMENT FOR INSTALLATION THEREOF

(71) Applicant: Precasteel, LLC, Skillman, NJ (US)

(72) Inventors: Gary Michael Dinmore, Skillman, NJ (US); John Stanley Deerkoski, Warwick, NY (US)

(73) Assignee: Precasteel, LLC, Skillman, NJ (US)

( * ) Notice: Subject to any disclaimer, the term of this patent is extended or adjusted under 35 U.S.C. 154(b) by 0 days.

(21) Appl. No.: 15/728,085

(22) Filed: Oct. 9, 2017

(65) Prior Publication Data

US 2018/0030745 A1 Feb. 1, 2018

Related U.S. Application Data

(63) Continuation-in-part of application No. 14/099,510, filed on Dec. 6, 2013, now Pat. No. 9,783,982.

(Continued)

(51) Int. Cl.
*E04B 5/36* (2006.01)
*E04G 11/36* (2006.01)

(Continued)

(52) U.S. Cl.
CPC ..... *E04B 5/36* (2013.01); *E01D 19/103* (2013.01); *E01D 21/00* (2013.01); *E01D 21/10* (2013.01);

(Continued)

(58) Field of Classification Search
CPC ..... E04B 2005/322; E04B 5/32; E04B 5/36; E04D 13/15

(Continued)

(56) References Cited

U.S. PATENT DOCUMENTS 12,676 A 4/1855 Ellis
481,243 A * 8/1892 Orr ..... 52/781.3

(Continued)

FOREIGN PATENT DOCUMENTS

DE 299 08 482 01 U1 9/1999
EP 0732307 A2 9/1996

(Continued)

OTHER PUBLICATIONS

International Search Report and Written Opinion, PCT Application No. PCT/US2013/073754, dated Mar. 26, 2014, 6pp.

*Primary Examiner* — Michael Safavi
(74) *Attorney, Agent, or Firm* — Rita C. Chipperson; Chipperson Law Group, P.C.

(57) ABSTRACT

Stay-in-place forms and methods and equipment for installing thereof. A concrete form includes a vertical component and a horizontal component, the vertical component located substantially perpendicular to the horizontal component. Also, the form includes an interior surface, at least a portion of the interior surface providing a form for supporting uncured concrete; wherein the uncured concrete forms a concrete structural portion upon curing of the uncured concrete; and wherein the interior surface remains attached to the concrete structural portion after curing. The form may include inserts and compatible form attachments. Also, forms including recesses may be utilized to reduce the weight thereof. Lifting equipment and accessories may be utilized to lift the form from a form holder and set same in place. Forms contain the work area as soon as it is installed to minimize fall hazards and the time, costs, and downtime associated with installation of safety measures.

20 Claims, 39 Drawing Sheets

Related U.S. Application Data

(60) Provisional application No. 61/734,418, filed on Dec. 7, 2012.

(51) Int. Cl.

| | |
|---|---|
| ***E01D 21/10*** | (2006.01) |
| ***E01D 21/00*** | (2006.01) |
| ***E04B 5/32*** | (2006.01) |
| ***E04B 5/40*** | (2006.01) |
| ***E01D 19/10*** | (2006.01) |
| *E04G 19/00* | (2006.01) |
| *E04C 5/06* | (2006.01) |

(52) U.S. Cl.
CPC ..... *E04B 5/32* (2013.01); *E04B 5/40* (2013.01); *E04G 11/365* (2013.01); *E04B 2005/322* (2013.01); *E04C 5/0627* (2013.01); *E04G 19/003* (2013.01)

(58) Field of Classification Search
USPC ..... 52/94, 95, 96, 610, 258, 259, 236.8
See application file for complete search history.

(56) References Cited

U.S. PATENT DOCUMENTS

| | | | | |
|---|---|---|---|---|
| 1,547,012 | A * | 7/1925 | Arnn | 52/351 |
| 1,821,355 | A * | 9/1931 | Murray | 52/336 |
| 2,148,189 | A | 8/1937 | Curran | |
| 2,390,379 | A * | 12/1945 | Martin | 52/16 |
| 2,621,617 | A * | 12/1952 | Piatt | 52/94 |
| 2,649,059 | A * | 8/1953 | Mercier | 52/81.6 |
| 2,921,354 | A | 3/1956 | Pankey et al. | |
| 3,272,096 | A | 4/1963 | Lum | |
| 3,089,281 | A * | 5/1963 | Borges | 52/86 |
| 3,133,377 | A * | 5/1964 | Jackson | 52/24 |
| 3,315,578 | A | 9/1964 | Wesch et al. | |
| 3,323,266 | A * | 6/1967 | Dalkas | 52/302.3 |
| 3,587,964 | A | 6/1971 | Cork | |
| 3,842,552 | A | 10/1974 | Hudson | |
| 4,048,772 | A * | 9/1977 | Gaul | 52/136 |
| 4,067,166 | A * | 1/1978 | Sheahan | 52/592.6 |
| 4,175,363 | A * | 11/1979 | Moskowitz | 52/294 |
| 4,260,296 | A * | 4/1981 | Hilfiker | 405/284 |
| 4,426,176 | A * | 1/1984 | Terada | 405/285 |
| 4,967,528 | A | 11/1990 | Doran | |
| 5,060,438 | A * | 10/1991 | O'Rourke | 52/371 |
| 5,065,561 | A | 11/1991 | Mason | |
| 5,471,811 | A | 12/1995 | House et al. | |
| 5,669,194 | A * | 9/1997 | Colasanto et al. | |
| 5,845,445 | A | 12/1998 | Blackbeard | |
| 6,099,942 | A * | 8/2000 | Yakushinji | 428/192 |
| 6,295,782 | B1 | 10/2001 | Fyfe | |
| 6,634,148 | B2 | 10/2003 | Shidler | |
| 6,792,728 | B2 * | 9/2004 | Toulemonde et al. | 52/251 |
| 6,878,323 | B2 | 4/2005 | Fyfe | |
| 9,783,982 | B2 | 10/2017 | Dinmore et al. | |
| 2009/0184230 | A1 | 7/2009 | Carney, Jr. | |
| 2009/0218474 | A1 | 9/2009 | Bowman | |
| 2010/0024331 | A1 * | 2/2010 | Stiffler et al. | 52/236.8 |
| 2011/0173905 | A1 | 7/2011 | Hanback | |
| 2012/0017522 | A1 | 1/2012 | Hanback | |
| 2012/0056344 | A1 | 3/2012 | Richardson et al. | |

FOREIGN PATENT DOCUMENTS

| | | |
|---|---|---|
| EP | 1 888 111 A2 | 1/2008 |
| WO | 9404756 A1 | 3/1994 |

* cited by examiner

STAY-IN-PLACE FORMS AND METHODS AND EQUIPMENT FOR INSTALLATION THEREOF

BACKGROUND OF THE INVENTION

Embodiments of the present invention generally relate to stay-in-place fascia forms and methods and equipment for installation thereof. Conventional construction methods for building bridges are known including those which use bridge brackets, scaffolding, and many other types of form support to support the loads from wet concrete. Fascia formwork is typically made from wood or steel and requires removal after the bridge is constructed. Known apparatus and methods involve substantial issues of safety and maintenance and protection of traffic ("MPT"). Known apparatus and methods also incur substantial labor cost, material cost, and costs associated with handling and disposal of such materials.

A common method of bridge building includes the use of bridge brackets installed along the fascia of the bridge and at or near the bottom of the bridge deck. Such brackets are typically installed with wooden forms that require removal after concrete placement. This method is labor intensive and results in high material costs. Moreover, disposal costs, MPT costs (if applicable), and safety costs are incurred.

Concrete paving machines are also known for bridge construction. Such machines use truss units to carry the machine and associated parts. They also use bogie wheel, rails, and screw jack adjustors to facilitate the paving process.

SUMMARY OF THE INVENTION

Briefly stated, in one aspect of the present invention, a concrete form is disclosed. This concrete form includes a vertical component and a horizontal component, the vertical component located substantially perpendicular to the horizontal component. Also, the form includes an interior surface, at least a portion of the interior surface providing a form for supporting uncured concrete; wherein the uncured concrete forms a concrete structural portion upon curing of the uncured concrete; and wherein the interior surface remains attached to the concrete structural portion after formation.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
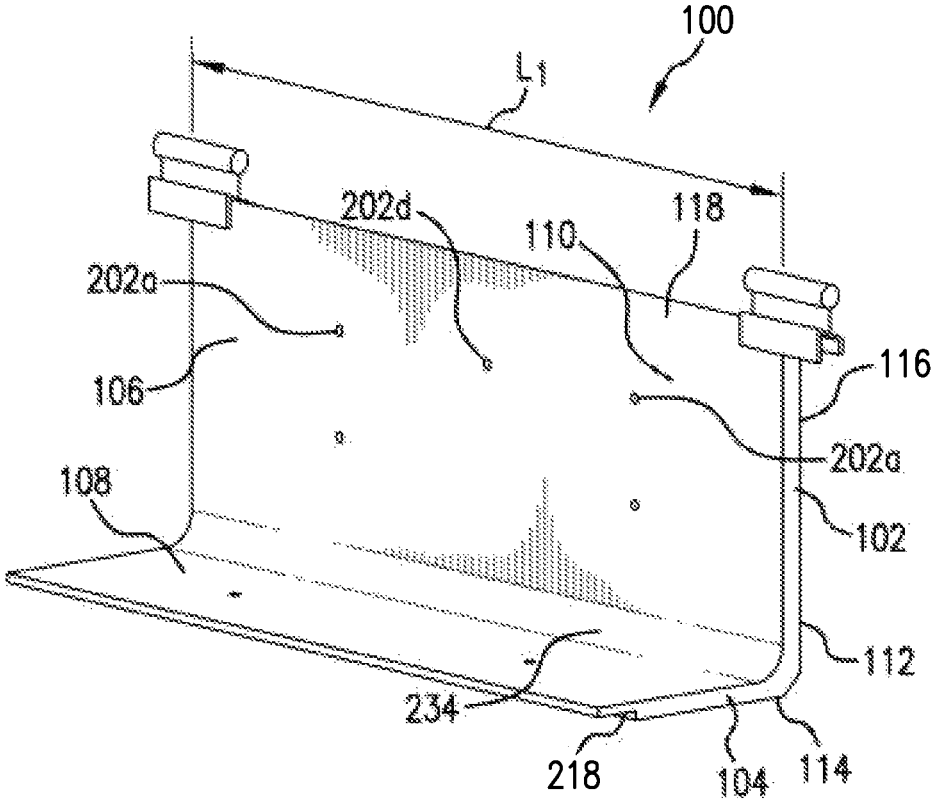
FIGS. 1A and 1B depict perspective and plan views of a stay-in-place fascia form in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a form" may include a plurality of forms. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Figure 1B:
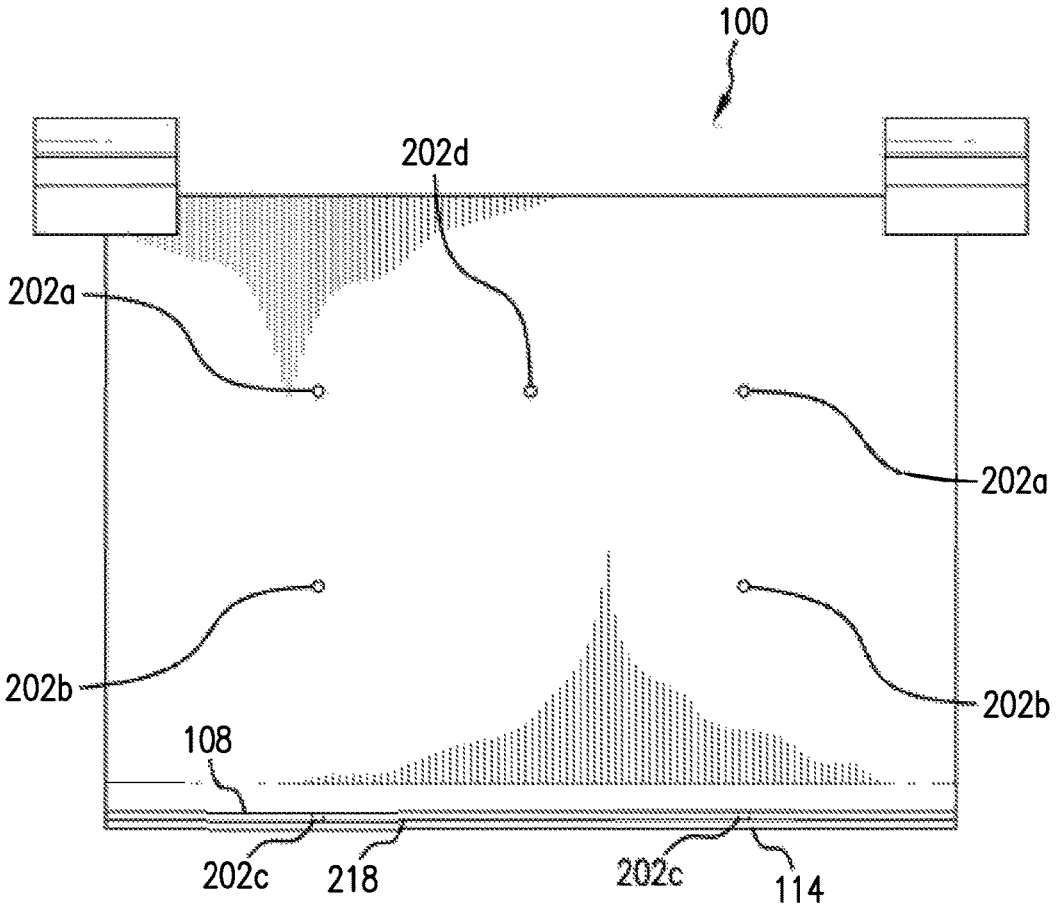

Referring now to FIGS. 1A and 1B, depicted is an exemplary stay-in-place fascia form 100 in accordance with one embodiment of the present invention. This exemplary form 100 is utilized as a form for supporting uncured concrete, and, after the concrete has cured, form 100 remains an integral part of the structure formed thereby. This exemplary form 100 is intended for use in the construction of new bridges, specifically, bridge barriers such as traffic barriers. Although the described use of form 100 is new bridge construction and barriers for same, the systems and methods of the present invention are not limited to use for building bridges. They may be incorporated for the construction of other structures or other uses including, without limitation, bridge repair and/or rehabilitation, parapet construction, building construction, and the like.

When used for bridge building, form 100 contains the work area as soon as it is installed as discussed in greater detail below, which minimizes or eliminates fall hazards, thereby eliminating the time, costs (e.g., labor costs, removal costs, disposal costs, etc.), and downtime associated with installation of safety measures that are typically required (e.g., formwork, scaffolding, road closure, etc.) to contain the work area. That is, minimal or zero excess materials are needed to contain the work area since the form performs this task while also remaining in place after construction to become part of the structure being built. Also, the disruption of traffic or other environmental considerations beneath the structure being built is minimized as all work can be safely performed from atop the structure.

Figure 2:
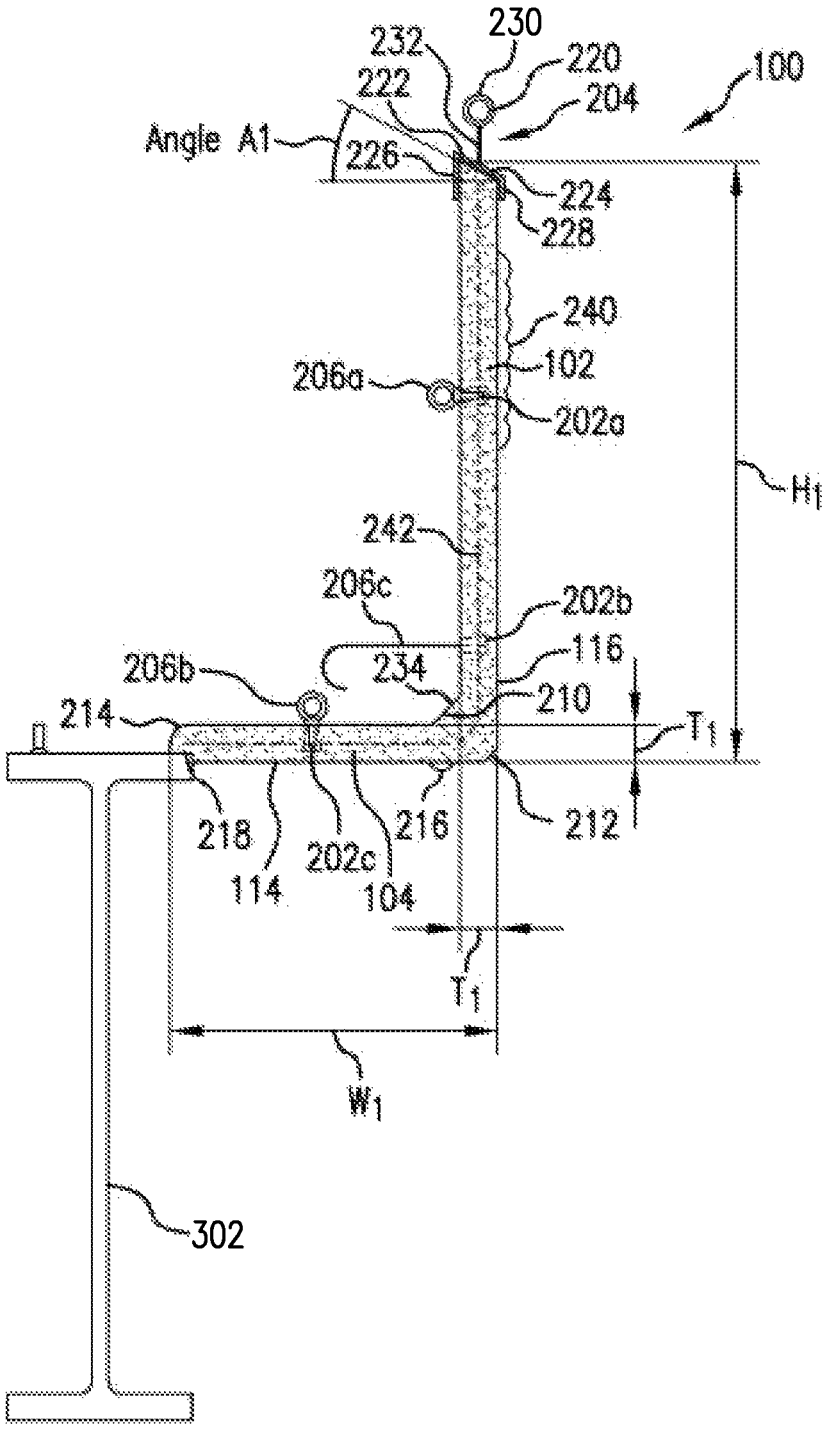
FIG. 2 depicts a side view of the fascia form of FIGS. 1A and 1B positioned atop the outer edge of a structural member in accordance with one embodiment of the present invention.

Now referring to FIGS. 1A, 1B, and 2, form 100 is a relatively thin, substantially L-shaped panel that includes vertical component 102 and horizontal component 104. In the depicted embodiment, vertical component 102 is located substantially perpendicular to horizontal component 104, however, alternate orientations may be substituted.

Vertical and horizontal components 102 and 104, respectively, have thicknesses $T_1$ of approximately two inches (2"), however, alternate thicknesses may be substituted without departing from the scope of the present invention. Also, embodiments are envisioned in which the thicknesses of the vertical and horizontal components are not equal.

The height $H_1$ of form 100 is approximately forty four inches (44"), the width $W_1$ is approximately two feet (2'), and the length $L_1$ is approximately sixty inches (60"), however, varied dimensions may be substituted to accommodate, for example, desired size of the structure being built as well as material strength and geometric boundaries. For example, alternate embodiments are envisioned in which width $W_1$ is approximately twelve inches (12"), but the invention is not so limited.

As best seen in FIG. 2, in the depicted embodiment of the present invention, upwardly facing surface 222 of vertical component 102 inclines upwardly and inwardly toward interior surface 106 at an angle of approximately thirty degrees (30°), however, varying angles may be substituted.

Form 100 has an interior surface 106 that includes upwardly facing surface 108 of horizontal component 104, inwardly facing surface 110 of vertical component 102, and inwardly facing surface 234 of joining component 210. In the exemplary embodiment of the present invention shown in FIG. 2, joining component 210 extends at an angle of 45 degrees (45°) relative to said inwardly facing surface 110 of said vertical component and said upwardly facing surface 108 of said horizontal component. However, alternate configurations may be substituted without departing from the scope hereof.

Interior surface 106 provides a form for supporting uncured concrete as discussed in greater detail below. Once the concrete has cured, form 100 remains in place and forms a structural portion of the bridge being built or remains in place as a permanent part that does not have structural significance. That is, interior surface 106 remains attached to the cured concrete after curing/formation of same. In this case, exterior surface 112 becomes an exterior surface of the bridge. In some embodiments such as the one depicted in FIG. 2, exterior surface 112 includes one or more ornamental features 240 or other aesthetics to provide a decorative exterior or surface for the structure. Exterior surface 112 may include the downwardly facing surface 114 (e.g., a soffit) of horizontal component 104, the outwardly facing surface 116 of vertical component 102, bevel 212, and/or any portion or combinations of the aforementioned items.

In some embodiments of the present invention such as that shown in FIG. 2, the upper corner of a distal end of horizontal component 104 is in the form of rounded edge 214. However, alternate configurations and/or shapes for this edge may be substituted including, without limitation a squared edge, a chamfered edge or edge treatment. Or edge 214 may be omitted, without departing from the scope hereof.

Additionally, in some embodiments of the present invention such as that shown in FIG. 2, bevel 212 extends longitudinally along the intersection of outwardly facing surface 116 of vertical component 102 and downwardly facing surface 114 of horizontal component 104. Bevel 212 acts as a drip edge to cause water to drip downward rather than along downwardly facing surface 114. Bevel 212 is located at an angle of forty-five degrees (45°) relative to outwardly facing surface 116 of vertical component 102 and downwardly facing surface 114 of horizontal component 104. However, alternate configurations and/or shapes for this bevel may be substituted, or bevel 212 may be omitted, without departing from the scope hereof.

Additionally, in some embodiments of the present invention such as that shown in FIG. 2, protrusion 216 extends below downwardly facing surface 114 of horizontal component 104 directly below joining component 234. Protrusion 216 has a substantially semicircular cross-section, and it acts as a drip strip to cause water to drip downward rather than along downwardly facing surface 114. Protrusion 216 and bevel 212 both act to eliminate or minimize the amount of water that reaches structural support 302 in an effort to minimize corrosion thereof. However, alternate configurations, locations, and/or shapes for this protrusion may be substituted, or protrusion 216 may be omitted, without departing from the scope hereof including, without limitation, a longitudinal recess.

Form 100 may be formed of many different types of materials or combinations thereof, provided that the strength of the material, or combination of materials, is sufficient to hold the implied loads such as that of the uncured concrete. In the depicted embodiment, form 100 is made from 5,000 PSI fiber-reinforced concrete, however, other materials, or combinations of materials, including, but not limited to, polymers and/or high strength concretes may be substituted.

Optionally, form 100 may include an interior reinforcement 242. In the depicted embodiment, interior reinforcement 242 is a four-by-four (4"×4") epoxy-coated, welded wire mesh that extends substantially throughout the height of vertical component 102 and the width of horizontal component 104 with the exception of a bend at the intersection thereof. The portion of the depicted interior reinforcement 242 located within vertical component 102 is located approximately equidistant from inwardly facing surface 110 and outwardly facing surface 116. The portion of the depicted interior reinforcement 242 located within horizontal component 104 is located approximately equidistant from upwardly facing surface 108 and downwardly facing surface 114. These two portions are connected to each other via a curve in the interior reinforcement, such curve having a radius of approximately four inches (4"). However, alternate locations and configurations may be substituted including, without limitation, reinforcements made of carbon mesh or other materials having tensile strength and reinforcements having partially exposed portions (portions that extend beyond the confines of form 100). Or interior reinforcement 242 may be omitted without departing from the scope hereof.

Form 100 may optionally include a rabbet such as rabbet 218 to assist in placement of form 100 atop a structural member 302 (e.g., a girder, stringer, etc.) as discussed in greater detail below. In the depicted embodiment, rabbet 218 extends longitudinally along the distal lower corner of horizontal component 104 and it is substantially L-shaped. That is, when form 100 is viewed in its upright position, rabbet 218 is in the form of an L that has been inverted and rotated 90 degrees counterclockwise. However, alternate shapes may be substituted without departing from the scope hereof. Further, although structural member 302 is depicted in the shape of a traditional bridge girder, structural member may have virtually any shape or configuration and form 100 and/or rabbet 218 may be modified accordingly, as needed.

As best seen in FIG. 2, form 100 includes a plurality of inserts 202. In the depicted embodiment, inserts 202 are threaded, plastic inserts such as the precast concrete plastic inserts manufactured by A.C. Miller Concrete Products, Inc. and having model no. IN-025 through IN-150. However, alternate inserts may be substituted including, but not limited to, galvanized steel inserts and non-threaded inserts. Or, apertures passing completely through horizontal and/or vertical components 102 and 104, respectively, may be substituted. In the depicted embodiment, inserts 202 are embedded in form 100 during manufacturing thereof (e.g., during the casting of the form via a concrete mold), however, alternate embodiments are envisioned in which such inserts are installed after casting and/or placement of form 100 as discussed in greater detail below. Additionally, although form 100 includes seven (7) inserts 202, varying quantities may be substituted. For example, in one alternate embodiment, a plurality of inserts are provided in the form of a grid to allow multiple exterior reinforcement style form attachments 206 to be installed (as discussed below) to increase the coupling between form 100 and any adjacent cast-in-place concrete structures or structure portions.

In the depicted embodiment, inserts 202 are compatible with a variety of form attachments 206. Form attachments 206 may perform any one of a number of functions including, without limitation, assisting with installation of form 100, increasing the strength of the interface between form 100 and the cured concrete, and the like. Form attachments 206 may be any one of a plurality of commercially available connection devices. For example, in the depicted embodiment, form attachments 206*a* and 206*b* are one-half inch (½") threaded shank eye bolts with a shoulder as manufactured by Chicago Hardware, and form attachments 206*c* and 206*d* are exterior reinforcements. In the depicted embodiment, this exterior reinforcement is a reinforcement bar of Grade 60 (i.e., 60,000 PSI) such as an imperial size #4, one half inch (½") diameter reinforcement bar that includes threads on its proximal end (e.g., these threads may be added during manufacturing or during construction of the structure) and a J-shaped hook on its distal end. However, alternate exterior reinforcements may be substituted without departing from the scope hereof. Form attachments 206 connect to form 100 by simply threading of same into a compatible insert such as insert 202 as discussed above.

Form attachments 206*a* and 206*b* facilitate attachment of a tie or the like during installation of form 100 and prior to the pouring of concrete as discussed in greater detail below. That is, the tie may be threaded through the eye of form attachments 206*a* and 206*b* prior to the tying thereof. In the depicted embodiment, form attachments 206*a* are threaded into inserts 202*a*, and form attachments 206*b* are threaded into inserts 202*c* as depicted in FIG. 2.

Additionally, a form attachment 206*a* or 206*b* may be threaded into insert 202*d* to facilitate coupling of form 100 to a lifting cable 310 via a coupler 309 or the like prior to placement of same as discussed below. That is, coupler 309 or the like may be inserted through a form attachment 206 and/or a shackle coupled thereto to lift facilitate the lifting of form 100 from a stack of forms and/or from a form holder such as form holder 404 as described below with respect to FIGS. 4A and 4B. In the depicted embodiment, such an attachment is threaded into insert 202*d*, which is located at the center of gravity of form 100. This location minimizes movement of the form during lifting and placement, however, alternate locations may be substituted without departing from the scope hereof. After the form is set in place and detached from lifting equipment 402, form attachment 206*a* may be removed from insert 202*d* to allow the threading of a different form attachment thereto including, without limitation, form attachments 206*a*, 206*b*, 206*c*, and/or 206*d* as discussed above.

Form attachments 206*c* and 206*d* increase the bond between form 100 and the concrete poured adjacent thereto. That is, after the concrete is poured, exterior reinforcement-style form attachments 206*c* and 206*d* are encased therein and form a stronger, more permanent bond between form 100 and the poured concrete after curing of the latter. However, alternate form attachments 206, or varying quantities thereof, may be omitted or substituted without departing from the scope hereof. For example, form attachments 206 may include alternate hardware capable of coupling to, without limitation, S-hooks, shackles, coil rod ties, coil loop inserts, turnbuckles, washers and nuts, welded studs or hooked brackets and the like, some or all of which is capable of purposes including, but not limited to, attaching to existing or proposed steel, wood, or concrete structural members and facilitating the attachment of inboard formwork.

In one aspect of the depicted embodiment, interconnection clip 204 is optionally mounted on upwardly facing surface 118 of the vertical components 102 of adjacent forms 100. In the depicted embodiment, each approximate half of clip 204 is mounted atop upwardly facing surface 118 of the vertical components of two adjacent forms 100 as best seen in the side view of FIG. 2. This coupling of two forms 100 via clip 204 allows clip 204 to: distribute the load of each form 100 to its adjacent forms 100, if any; maintain alignment of forms 100; and/or provide a mounting surface for a railing or railing system.

As best seen in FIG. 2, this exemplary interconnection clip 204 includes top wall 224, inner wall 226, and outer wall 228. Top wall 224 mirrors the configuration of upwardly facing surface 222 of vertical component 102. That is, top wall 224 inclines upwardly and inwardly toward inner wall 226 at an angle of approximately thirty degrees (30°). Inner and outer walls 226 and 228, respectively, extend downward from the longitudinal edges of top wall 224 and extend throughout the full length of clip 204. The bottom edges of inner and outer walls 226 and 228, respectively, are located at the same height, thereby causing inner wall 226 to be taller than outer wall 228 due to the angled nature of top wall 224. However, alternate configurations of clip 204 may be substituted without departing from the scope hereof or clip 204 may be omitted entirely.

Interconnection clip 204 may optionally include railing support 220. In the depicted embodiment, railing support 220 includes a cylindrical portion 230 suspended above top wall 224 by vertical railing support component 232. Vertical railing support component 232 is approximately the same diameter as the railing to be threaded therethrough and has an inside diameter of approximately one and five-eighth inches (1⅝"), and is located along the approximate longitudinal centerline of top wall 224. In the depicted embodiment, clip 204 only extends approximately one-tenth the length of form 100, however, other distances may be substituted including, without limitation, a distance equal to the full length of form 100. Cylindrical portion 230 sits atop vertical railing support component 232 and is approximately centered thereupon. It extends the full length of top wall 222. However, alternate configurations and/or locations may be substituted without departing from the scope hereof.

After installation of form 100, a railing (e.g., a cable, pipe, etc.) may be installed through railing support 220 to extend partially or throughout the length of the bridge or other structure in accordance with OSHA guidelines (to prevent or minimize falls during construction of the structure) or for other purposes. That is, in one embodiment of the present invention, the height of form 100 is sufficient to eliminate the need for a railing as per OSHA requirements. However, once the deck 318 is poured, the height between the top of form 100 and deck 318 may become less than the minimum required by OSHA. In such a scenario, a railing may be added to meet OSHA requirements. However, alternate configurations of railing support 220 may be substituted without departing from the scope hereof or support 220 may be omitted entirely. Railing support 220 may also be eliminated without departing from the scope hereof. In one such embodiment, the height of form 100 is increased to allow the panel to exceed the railing height required by OSHA, thereby eliminating the need for a railing.

Referring now to FIGS. 3A through 3I, depicted are progressive side, perspective, and section views of a structure created via one process for installing form 100 on a structural member 302 in accordance with one embodiment of the present invention. In the depicted example, structural member 302 is a bridge fascia girder installed as known in the art. Prior to placement of form 100 on structural member 302, structural member attachment 304 is—mounted on the structural member via welding, J-hook bracket, or the like to facilitate the installation of ties that hold form 100 in place prior to the pouring of the concrete deck. In the depicted embodiment, structural member attachment 304 is a welded stud such as a High Strength, CPL Stud as manufactured by Nelson Stud Welding and having part no. 101021688.

Figure 3A:
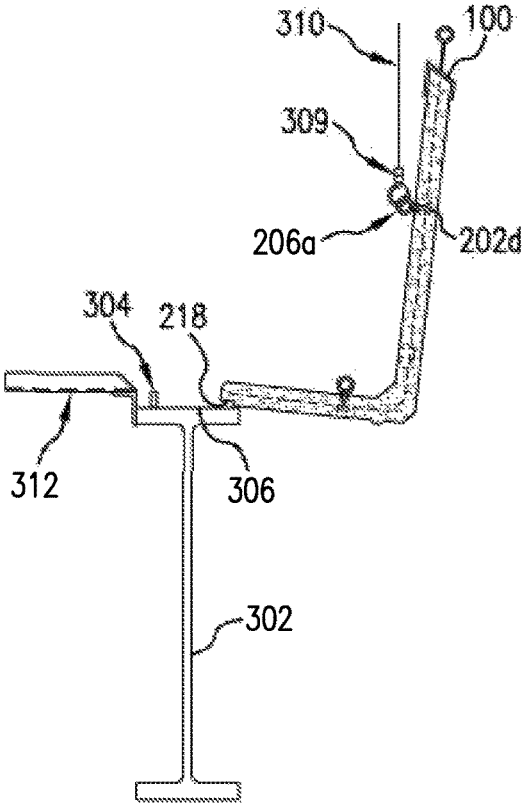
FIGS. 3A through 3I depict progressive side, perspective, and section views of a structure created via one process for creating a concrete structure utilizing the fascia form shown in FIGS. 1A, 1B, and 2 in accordance with one embodiment of the present invention.

In the depicted exemplary form 100, structural member attachment 304 is mounted approximately one and one half inches (1½") from the inner edge of upwardly facing surface 306 of structural member 302, however, alternate locations may be substituted. Structural member attachments 304 are located such that approximately two (2) structural member attachments 304 are utilized for installation of each form 100 as best seen in FIG. 3B, however, varying quantities may be substituted.

Also, alternate structural member attachments may be substituted without departing from the scope hereof. For example, structural member attachments may be type B4L standoff support studs, type R9L rope hook studs, Type R6P rectangular slotted studs, type SBL shoulder studs, type TBL internally threaded studs, all as manufactured by Nelson Stud Welding. Or, alternatively, structural member attachments may be designed to hook onto the side of structural member 302, thereby eliminating the need for welding thereof. One such structural member attachment is the Century Series Hanger having model no. C130 as manufactured by Dayton Superior.

In yet another alternate embodiment, a formwork attachment may be substituted for, or used in addition to, the structural member attachment. One such formwork attachment is a galvanized hook that hooks into a slot that is cut into formwork such as formwork 312. Other formwork attachments may include, but are not limited to, Hook Bolts having model no. D1-J, D1LA, or D1L, coil loop straight inserts having model no. B16, Inside Tie Rods having model nos. D1 and D18, and/or a heavy duty screed support having model no. G15, all as manufactured by Dayton Superior.

Figure 3C:
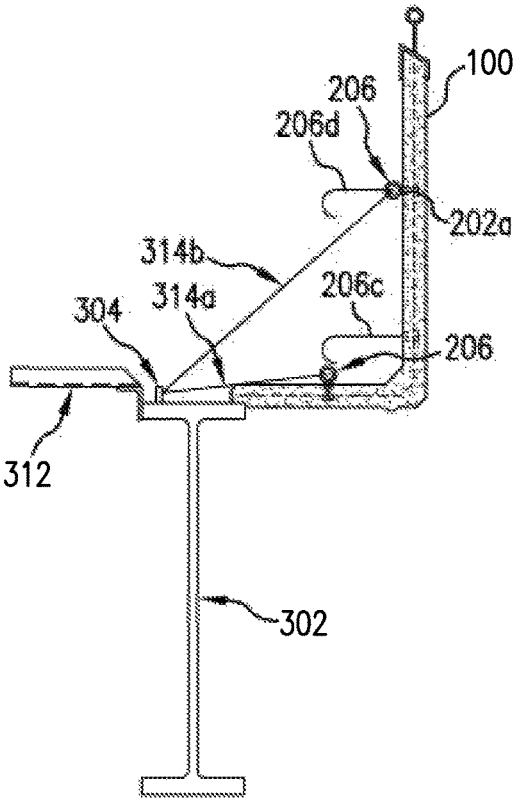
Figure 3B:
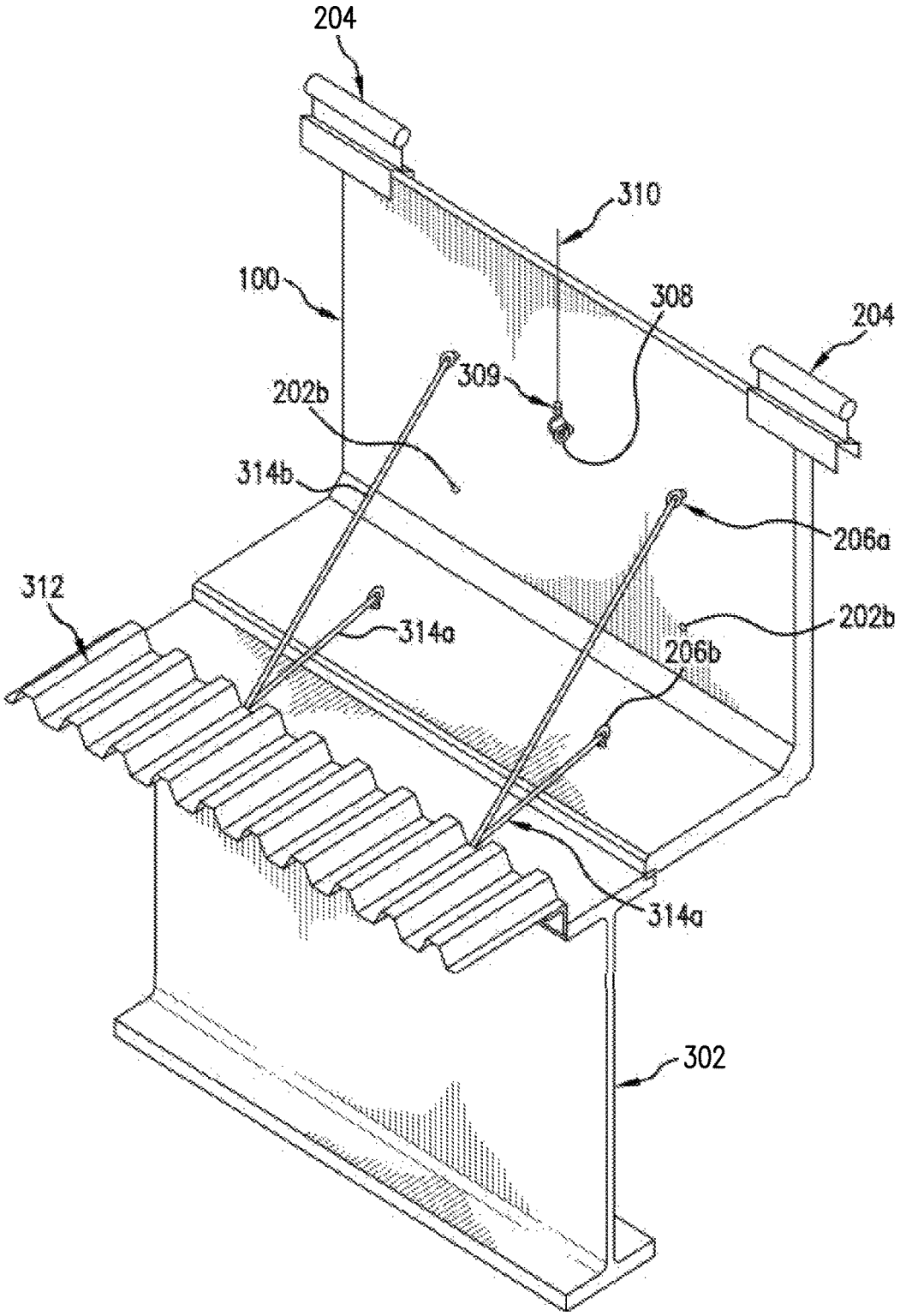

After structural member attachments 304 are in place (as best seen in FIG. 3C), form 100 may be lifted via any capable lifting equipment (e.g., a crane, davit, etc.) such as that equipped with a lifting cable 310 or the like for placement atop structural member 302. One such method is described below with respect to FIG. 4B. Lifting cable 310 and an associated coupler 309 or the like may attach to form 100 via a direct or indirect attachment to form attachment 206*a*. For example, intermediate coupling devices such as a shackle or the like may couple coupler 309 to form attachment 206*a*.

FIG. 3A depicts a side view of form 100 after it is lowered atop structural member 302 such that rabbet 218 aligns with the upper and outer edge of structural member 302. For the purposes of FIG. 3A, 202*a* located to the right of 202*d* (as best seen in FIG. 1B) has been removed to show one method of connecting lifting equipment 402 to insert 202*d*. Form 100 is then rotated by lifting equipment 402 until vertical component 102 is substantially plumb (i.e., substantially perpendicular to upwardly facing surface 306 of structural member 302) as best seen in the side view of FIG. 3C.

Thereafter, form 100 is tied in place utilizing form attachments 206*a*, 206*b*, structural member attachments 304, and one or more tie(s) 314 as described below in order to secure form 100 to structural member 302. FIG. 3B depicts form 100 after it has been tied in place. It should be noted that, in the depicted embodiment, tie(s) 314*b* are the primary support element (i.e., the primary mechanism utilized to hold the form in place prior to the pouring of the concrete) and tie(s) 314*a* are safety elements that prevent or minimize form 100 from being accidentally dislodged from structural support 302. Moreover, tie(s) 314*a* are installed in a substantially horizontal member as compared to tie(s) 314*b*, which are installed at an angle. End fittings for each of these ties may also be selected as needed. For example, tie(s) 314*a* may include adjusting nuts on one or more ends, whereas tie(s) 314*b* may include one or more turnbuckle-style end fittings. However, any end fitting may be substituted, or omitted, without departing from the scope of the present invention.

Tie(s) 314 may be Inside Tie Rods as manufactured by Dayton Superior and having model no. D1 or D18. Tie rods may include various end fittings on one or both ends including, without limitation, turn buckle fittings. However, no such fittings are required to implement the present invention. Also, alternate structural member attachments and/or ties including, without limitation, Richmond tie rod units may be substituted without departing from the scope hereof.

Figure 3D:
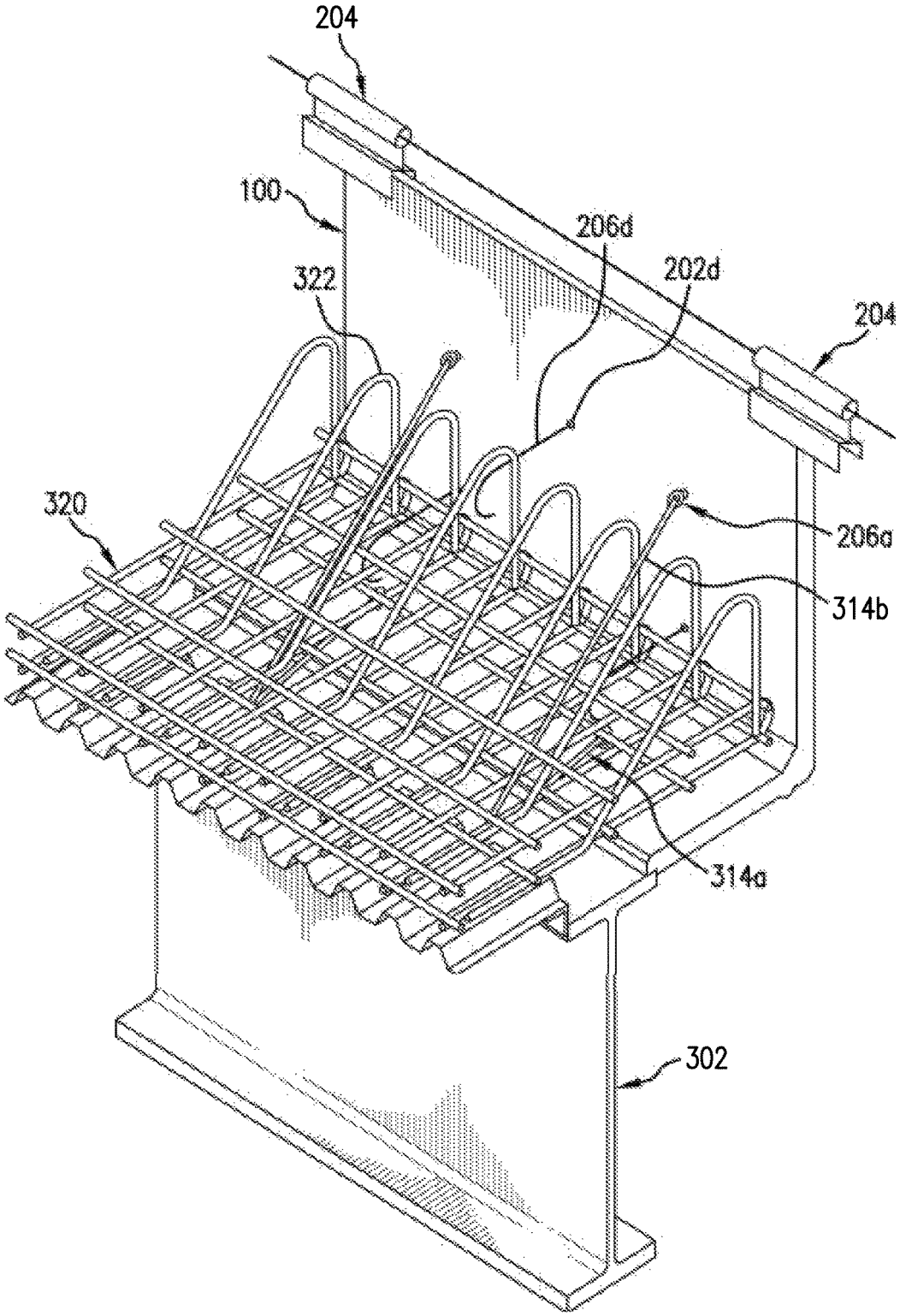
Figure 3E:
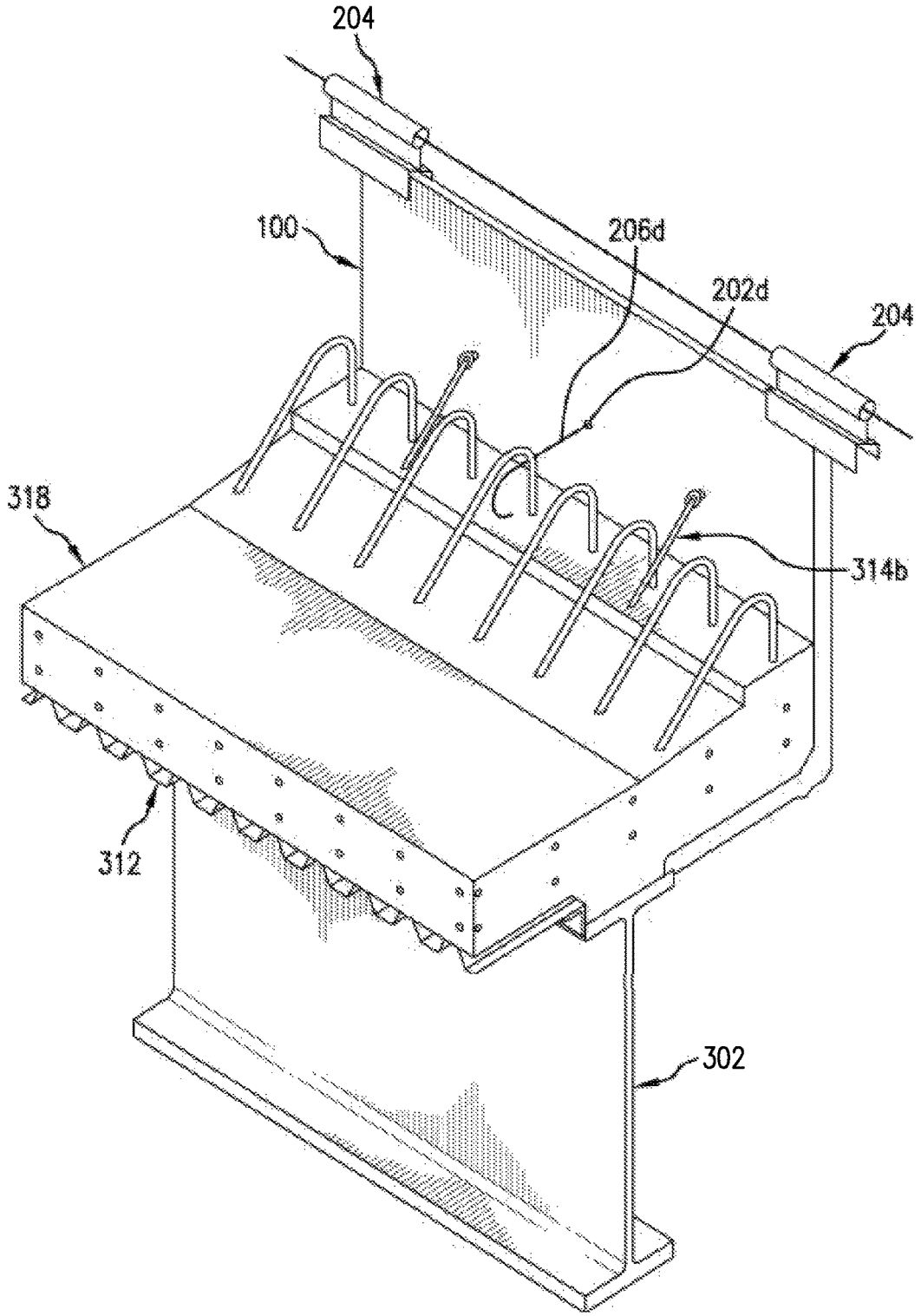

Form 100 may be disconnected from lifting equipment 402 as soon as it is secured in place, and any form attachments required for connection of form 100 to lifting equipment 402 may be removed, reused, or left in place/unused. Any other desired form attachments including, without limitation, exterior reinforcements or the like may be installed. For example, form attachments 206*c* and/or 206*d* may be installed in inserts 202*b* and/or 202*d* to further increase the bond between the cured concrete and form 100 as described in greater detail above. FIG. 3C depicts such exterior reinforcements after installation. Then, railing 316 may be threaded through railing supports 220. FIGS. 3D, 3E, and 3G depict railing 316 after installation. It should be noted that form attachment(s) such as form attachments 206*c* and 206*d* may be installed at an alternate point in the process so long as they are installed prior to the pouring of deck 318. Also, railing 316 may be installed at any point in the installation process.

FIG. 3B depicts a perspective view of form 100 mounted and tied atop structural member 302. FIGS. 3B and 3C also depict deck formwork 312, which is installed on the opposing side of structural member 302 utilizing methods known in the art. Although it is anticipated that formwork 312 is installed prior to placement of form 100 atop structural member 302, embodiments of the present invention are also envisioned in which form 100 is installed prior to formwork 312. It should also be noted that although formwork 312 is shown as an unfilled stay in place form, filled stay in place forms are also compatible with the systems and methods of the present invention. Such forms may be filled with fillers that include, but are not limited to, foam and concrete.

After form 100 is tied in place, it contains the work area as soon as it is installed as discussed in greater detail below, which minimizes or eliminates fall hazards, thereby eliminating the time, costs (e.g., labor costs, removal costs, disposal costs, etc.), and downtime associated with installation of safety measures that are typically required (e.g., formwork, scaffolding, road closure, etc.) to contain the work area. That is, minimal or zero excess materials are needed to contain the work area since the form performs this task while also remaining in place after construction to become part of the structure being built. Also, the disruption of traffic or other environmental considerations beneath the structure being built is minimized as all work can be safely performed from atop the structure.

FIG. 3D depicts a perspective view of form 100 mounted and tied atop structural member 302 as well as deck formwork 312, deck rebar 320, and primary barrier rebar 322 after it is installed on the opposing side of structural member 302, structural member 302, and upwardly facing surface 108 of horizontal component 104. Deck rebar 320 and primary barrier rebar 322 are installed as is also known in the art.

Referring now to FIG. 3E, depicted is a perspective view of form 100, structural member 302, and formwork 312 after the concrete has been poured to form deck 318. Deck 318 is formed upon the curing of the concrete.

Figure 3F:
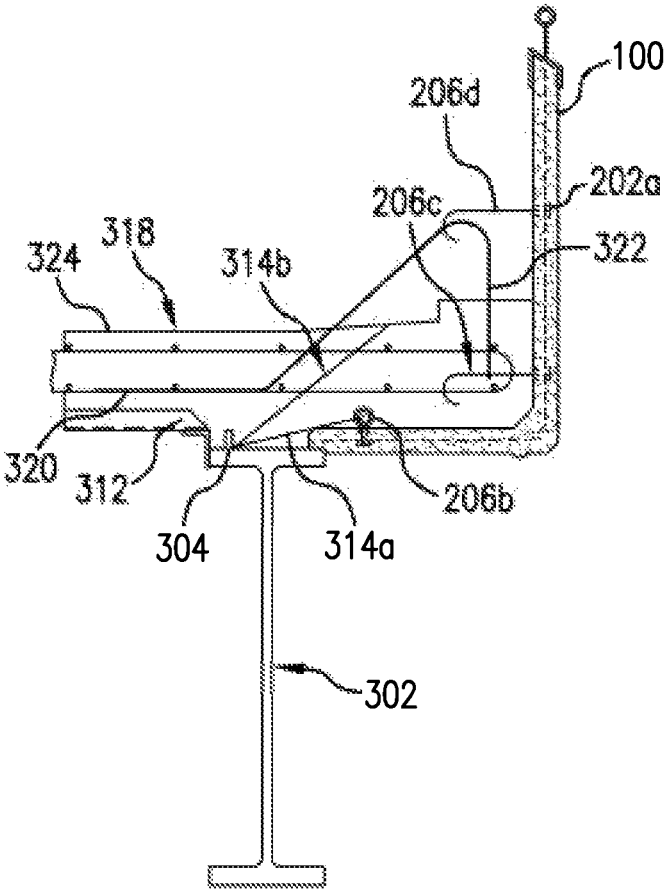
Figure 3G:
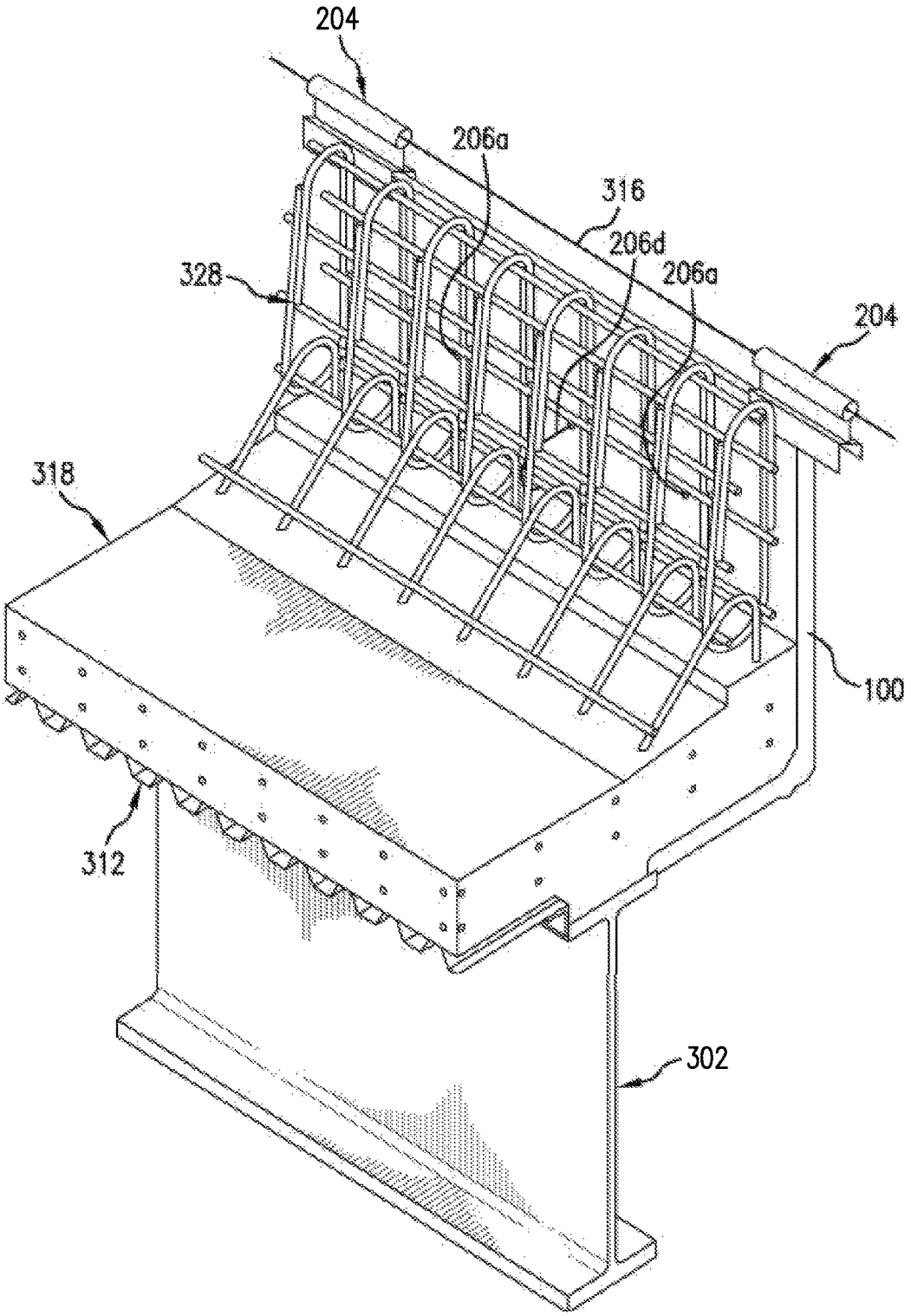

After the concrete is poured and cured, the portion of ties 314*b* extending above deck 318 may optionally be removed from form attachments 206*a* as depicted in the side view of FIG. 3F. However, form attachments 206*b* and 206*c* remain after curing of the concrete as they are encased therein.

Figure 3H:
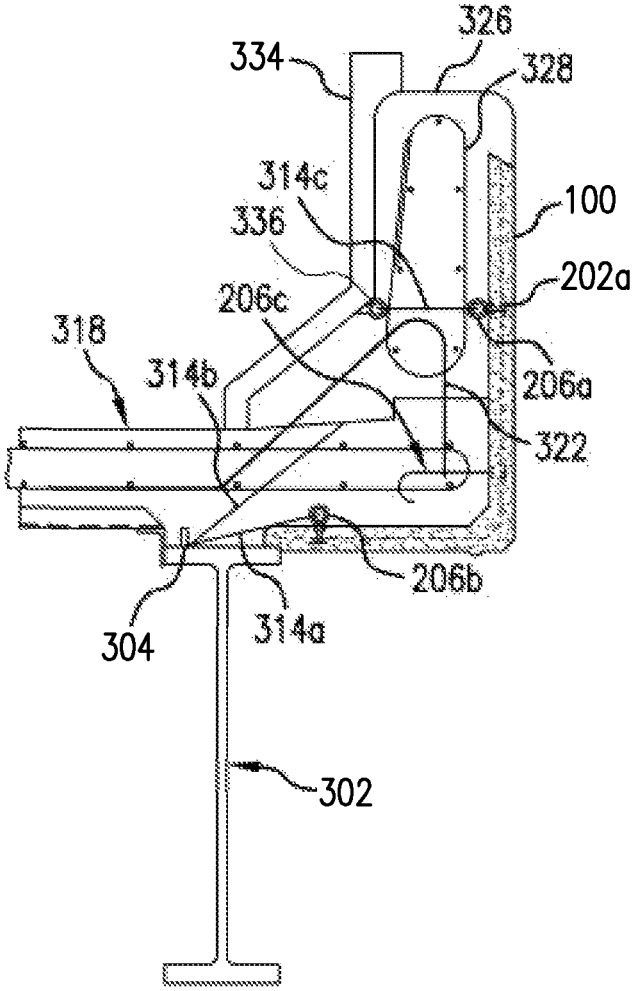

The encasing of exterior reinforcement style form attachments 206*c* in the concrete deck 318 (and form attachment 206*d* in barrier 326) further couples form 100 to concrete deck 318 and barrier 326, and facilitates the ability of form 100 to accommodate the shear and moment forces placed thereupon by the weight of the concrete deck 318. As discussed above, the portion of tie(s) 314*b* that extend above upwardly facing surface 324 of concrete deck 318 may optionally be removed after curing of the deck concrete. Alternatively, it may be left in place and encased in barrier 326 (See FIG. 3I). If a portion of tie(s) 314*b* are removed, form attachments 206*a* may also optionally be removed and/or replaced with new form attachments including, but not limited to, exterior reinforcement style form attachments such as form attachments 206*c* and 206*d* to increase the coupling of form 100 to the barrier to be mounted adjacent thereto as discussed below. Or, as is shown in the depicted embodiment, form attachments 206*a* are left in place and utilized to install substantially horizontal tie(s) 314*c* (as best seen in FIG. 3H). Ties 314(*c*) couple form 100 to inboard formwork 334 (i.e., the formwork utilized to pour barrier 326) prior to the pouring of the concrete for barrier 326 in an effort to further support the formwork and create a greater bond between form 100 and barrier 326 after curing of same. Tie(s) 314*c* also assist with resisting the pressure applied to formwork 334 and form 100 by the wet concrete poured to form barrier 326. Also, form attachments 206*a* may also be replaced with a differing attachment capable of coupling ties 314*c* to form 100 without departing from the scope hereof.

FIG. 3F depicts a side view of form 100, structural member 302, exterior reinforcement 206*c*, and formwork 312 after the concrete has been poured to form deck 318 including dashed lines to indicate the components encased therein, namely, deck rebar 320, primary barrier rebar 322, lower form attachment 206*b*, girder attachment 304, tie(s) 314*a*, a portion of tie(s) 314*b*, and exterior reinforcement 206*c*. As illustrated, primary barrier rebar 322 extends above upwardly facing surface 324 thereof.

FIG. 3G depicts a perspective view of deck 318 after curing of the concrete including structural member 302, formwork 312, primary barrier rebar 322, form 100, exterior reinforcement 206*d*, and secondary barrier rebar 328. Secondary barrier rebar 328 is installed within and above primary barrier rebar 322 as illustrated in FIG. 3G and as is known in the art.

Finally, inboard barrier formwork 334 is put in place, ties 314*c* are installed to secure formwork 334 to form 100, and the railing system installed for safety purposes (i.e. clips 204 and railing 316) is removed in preparation for the pouring of the barrier concrete. The railing system may be removed before or after installation of the inboard barrier formwork 334. Ties 314*c* are coupled to formwork attachment 336, which may be identical to, or similar to, form attachment 206*a*, however, such attachment 336 is coupled to formwork 334 either prior to, or after, such formwork is set in place. Then, the concrete for barrier 326 is cast in place.

Figure 3I:
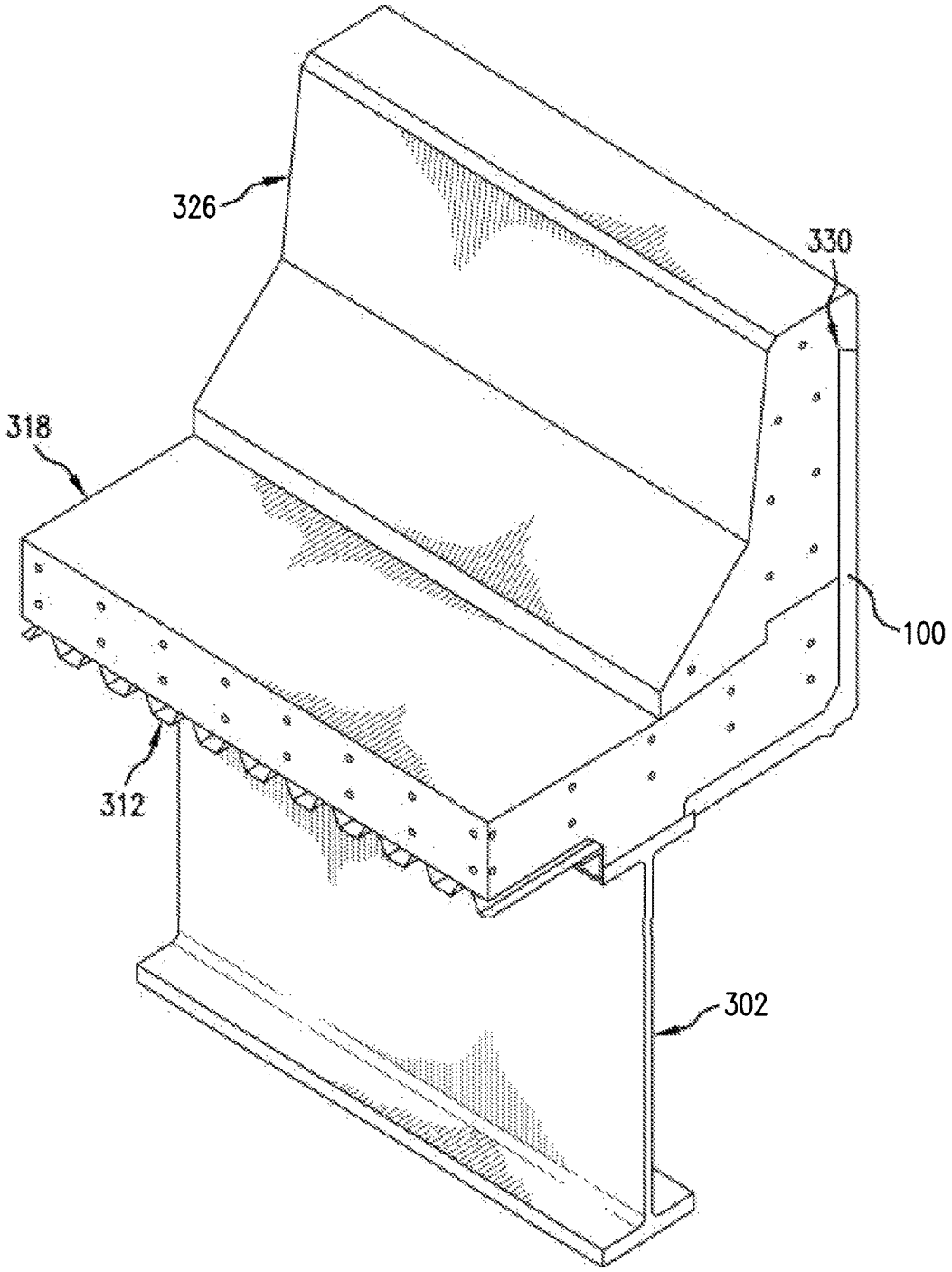

FIGS. 3H and 3I depict side and perspective views of form 100, structural member 302, tie(s) 314*c*, deck 318, barrier 326, and formwork 312 after the concrete has been poured to form barrier 326. FIG. 3H also depicts the components encased therein, namely, deck rebar 320, primary barrier rebar 322, secondary barrier rebar 328, lower form attachment 206*b*, structural member attachment 304, tie(s) 314*a*, a portion of tie(s) 314*b*, tie(s) 314*c* and exterior reinforcements 206*c* and 206*d*. The pouring of barrier 326 above upwardly facing surface 222 forms construction joint 330 between upwardly facing surface 222 and barrier 326.

Now referring to FIG. 4, embodiments of the present invention also generally relate to apparatus, systems, and methods for storing, transporting and/or installing fascia forms. Although the described use of such apparatus, systems, and methods is new bridge construction, the use thereof is not limited thereto.

As depicted in FIG. 4, system 400 includes, inter alia, lifting equipment 402, form holder 404, and work bridge 406. System 400 facilitates the erection/installation of a form such as, but not limited to, form 100 as discussed above. Form holder 404 is designed to support a plurality of forms in a stacked manner during storage, transportation, and installation. In the depicted embodiment, frame holder 404 is made of steel but alternate materials may be substituted including, without limitation, aluminum, other alloys, and combinations of the foregoing materials. Materials may be selected in order to minimize weight, but this is not required to implement the systems and methods of the present invention.

Figure 4A:
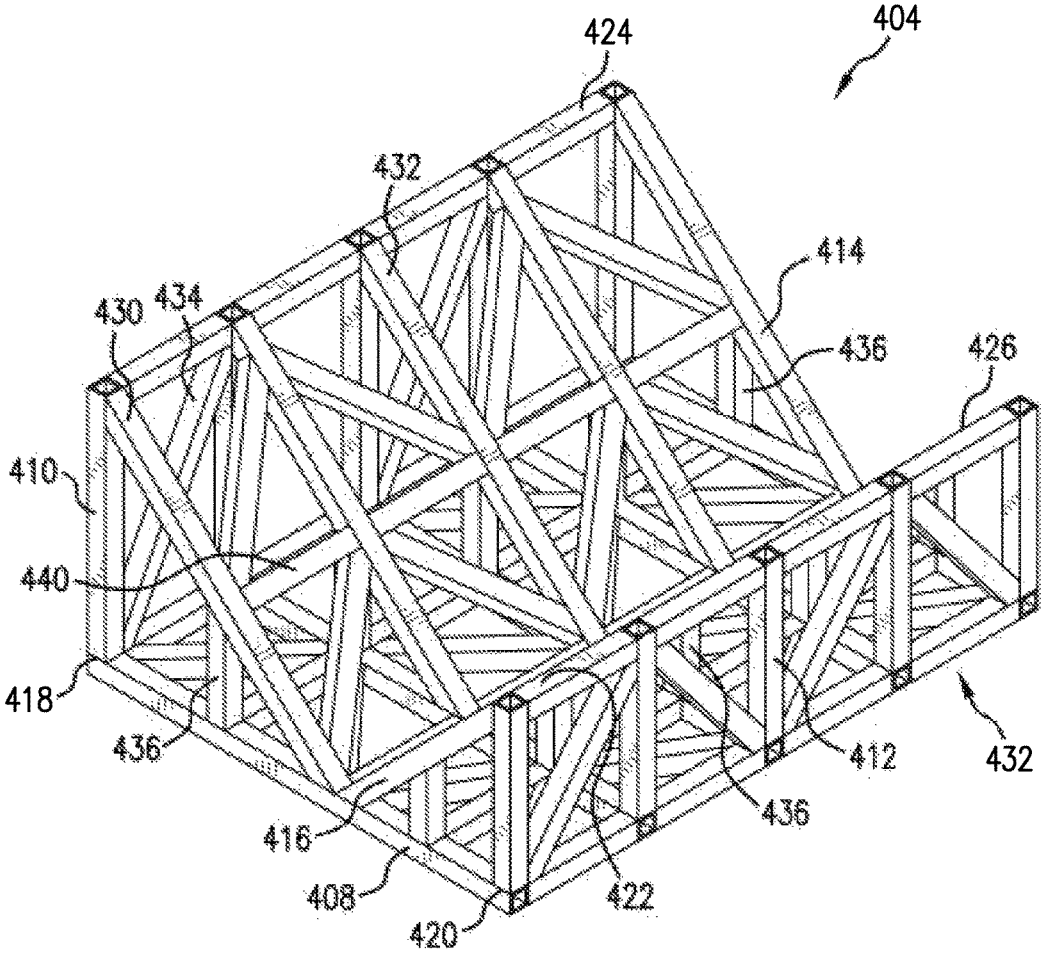
FIG. 4A depicts a perspective view of a form holder in accordance with one embodiment of the present invention.
Figure 4B:
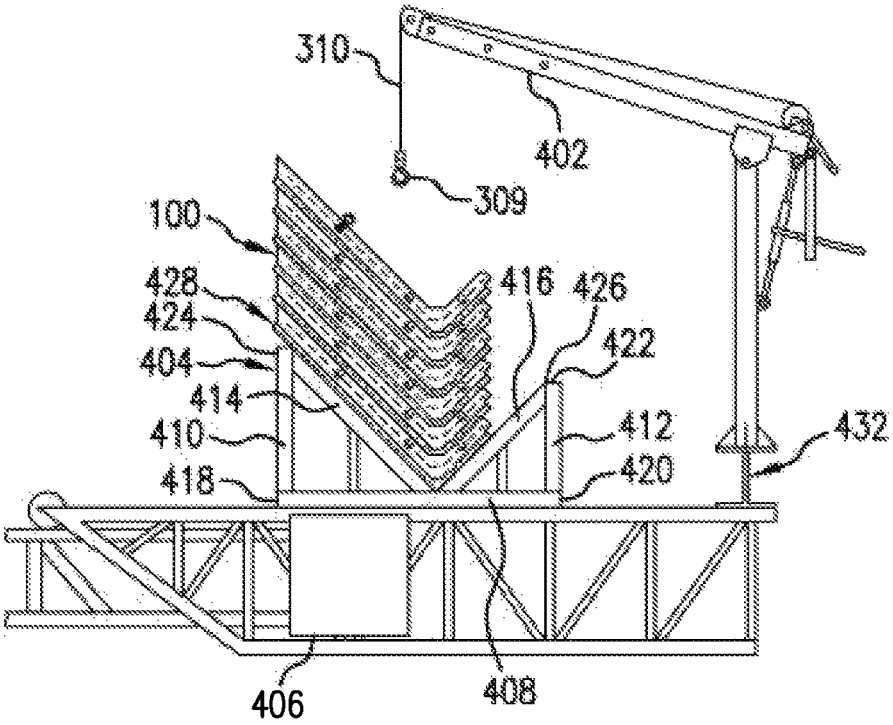
FIG. 4B depicts erection equipment for installing a plurality of forms stacked atop the form holder of FIG. 4A in accordance with one embodiment of the present invention.

As best seen in FIG. 4A, form holder 404 includes base section 408, rear section 410, front section 412, rear intermediate section 414, and front intermediate section 416, all of which are substantially rectangular. In the depicted embodiment, base section 408 and all of the aforementioned sections have lengths approximately equivalent to the forms to be supported by the form holder. However, varying lengths may be substituted without departing from the scope hereof.

More specifically, form holder 404 includes a substantially rectangular, substantially horizontal base section 408. A substantially rectangular rear section 410 extends vertically from a first longitudinal side 418 of base 408, and a substantially rectangular front section 412 extends vertically from a second longitudinal side 420 of base 408. A substantially rectangular front intermediate section 416 extends at an angle of approximately forty five degrees from a first upper longitudinal end 422 of said front section to base 408, and a substantially rectangular rear intermediate section 414 extends at an angle of approximately forty five degrees from a second upper longitudinal end 424 of said rear section to base 408. Rear intermediate section 414 intersects front intermediate section 416 at an angle of approximately ninety degrees.

Additionally, in the depicted embodiment, rear intermediate section 414 has a height approximately equal to a height of form 402 minus the width of rear section 410. The height of front intermediate section 416 is then selected to be the height that allows front intermediate section 416 to be located substantially perpendicular to rear intermediate section 414 without extending beyond front section 412. Similarly, the height of front section 412 is selected to be equivalent to topmost edge 426 of front intermediate section 416. However, varying dimensions may be substituted without departing from the scope hereof.

In the depicted embodiment of the present invention, each of the base section 408, rear section 410, front section 412, rear intermediate section 414, and front intermediate section 416 are substantially rectangular and are not solid. Rather, these sections are comprised of a plurality of subframe support members 430 arranged to form substantially rectangular and/or square subframes 432 for each section. Many of these subframes 432 include angled support members 434 as depicted in FIG. 4A. Such support members are provided to increase the strength of the corresponding section.

As also shown in FIG. 4A, a plurality of vertical section supports 436 may be added to support rear intermediate section 414 and/or front intermediate section 416 as necessary to increase the load bearing capabilities of form holder 404.

The above described configuration of form holder 404 allows a plurality of forms such as forms 100 to be stacked atop form holder 404 via lifting equipment such as lifting equipment 402 as described herein. In the depicted embodiment, spacers 428 are placed at predetermined intervals between form holder 404 and the bottommost form, and also between individual forms. In the depicted embodiment, spacers 428 are furring strips having a width of approximately one inch (1"), however, alternate spacers may be substituted without departing from the scope hereof Form holder 404 may also be used as a shipping pallet during transportation/shipping of one or more forms.

Also, embodiments of the present invention are envisioned in which one or more layers of one or more sheets of plywood is placed atop the upwardly facing surface 440 of rear intermediate section 414 and/or front intermediate section 416 to cover all or at least a portion thereof. Form 100 may be placed directly atop the plywood, or spacers 428 may be incorporated between the plywood and form 100 without departing from the scope hereof.

Forms 100 are stacked in a position in which they are rotated backwards at an angle of approximately forty five degrees. Form holder 404 of the depicted embodiment is capable of supporting approximately nine thousand (9,000) pounds, however, alternate load capabilities may be substituted without departing from the scope hereof.

As shown in FIG. 4, in the depicted embodiment, forms 100 and form holder 404 may be supported by workbridge 404 prior to installation. For example, workbridge 404 may be a Terex Bidwell thirty foot (30') by thirty four (34') foot heavy duty work bridge installed as in known in the art. The workbridge is lightweight and works within the spacing of the screed rails that are typically installed by the contractor that screeds the finished concrete. Forms and/or form holders with stacked forms may be located on one or both ends of workbridge 404 while still allowing a sufficient span between structural members to facilitate installation of forms as described herein. However, other workbridges or equipment performing a similar function may be substituted without departing from the scope hereof. The depicted embodiment of the present invention envisions a manually powered workbridge, however, workbridges having varying types of control may be substituted including, without limitation, hydraulic, motor-driven, and mechanically driven lifting equipment. In scenarios in which a hydraulic drive is used on the workbridge, the same operating engineer might control both the hydraulic drive system and hydraulically controlled lifting equipment.

In the depicted embodiment, lifting equipment 402 is a crane. For example, lifting equipment may be a manually controlled davit crane as manufactured by Dayton and having model no. 7CZ12. However, lifting equipment having varying types of control may be substituted including, without limitation, hydraulic, motor-driven, and mechanically driven lifting equipment. In scenarios in which a hydraulic drive is used on the workbridge, the same operating engineer might control both the hydraulic drive system and the hydraulically controlled davit.

Lifting equipment 402 may rest directly atop, for example, the screed or other equipment used for leveling the concrete. This equipment including, without limitation, wheels and rails is installed as in known in the art for the purpose of leveling the concrete. In some embodiments of the present invention, a support 432 such as a beam or the like may be utilized to further support and/or raise the height of lifting equipment 402.

In the depicted embodiment, lifting equipment 402 is equipped with a cable 310 and associated coupler 309 or the like capable of lifting individual forms via a form attachment **206*a* and a coupler 309 located at the approximate center of gravity of form 100. One such form attachment is a one-half inch (½") threaded shank eye bolt with a shoulder as manufactured by Chicago Hardware. Coupler 309 is passed through form attachment 206*a*. A shackle or the like may also be utilized to more securely attach coupler 309 to form attachment 206*a*. Thereafter, form 100 may be lifted from the stack of forms and/or form holder 404 and suspended over the side of the bridge relative to structural member 302 as shown in FIGS. 3A and 3B as discussed above. Form 100 may then be secured to structural member 302 via ties 314 and form attachments 206*a* as also discussed in greater detail above with respect to FIGS. 3A through 3**I.

The erection equipment allows quick installation. Further, safety is facilitated by making a positive connection with the form before it is lifted and after it is secured to the existing structure or structure being built. Moreover, the equipment allows a tie off point to facilitate safety before form 100 is installed and/or during conventional construction of the interior bridge deck bay when such construction follows the installation of form 100. However, the forms of the present invention may be installed utilizing other methods than that described herein without departing from the scope of the present invention.

Figure 5:
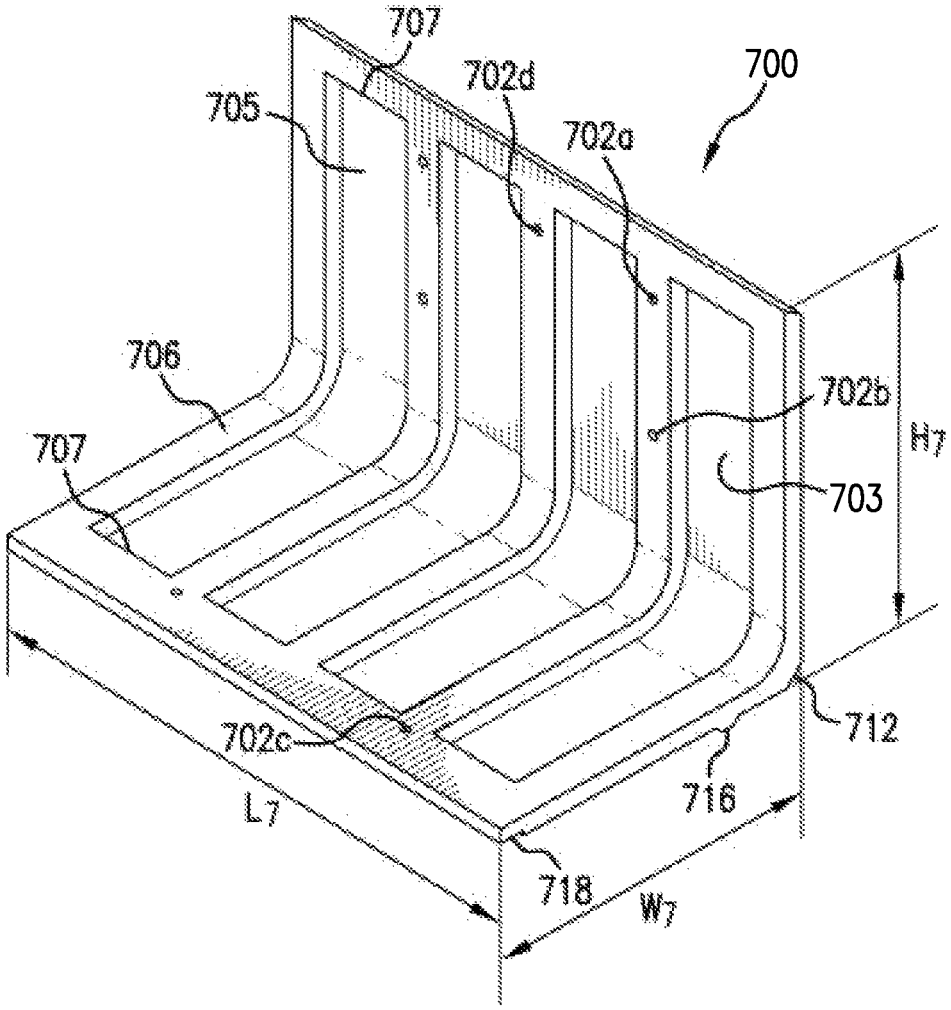
FIG. 5 depicts a perspective view of a stay-in-place fascia form having a plurality of recesses in accordance with one alternate embodiment of the present invention.
Figure 6:
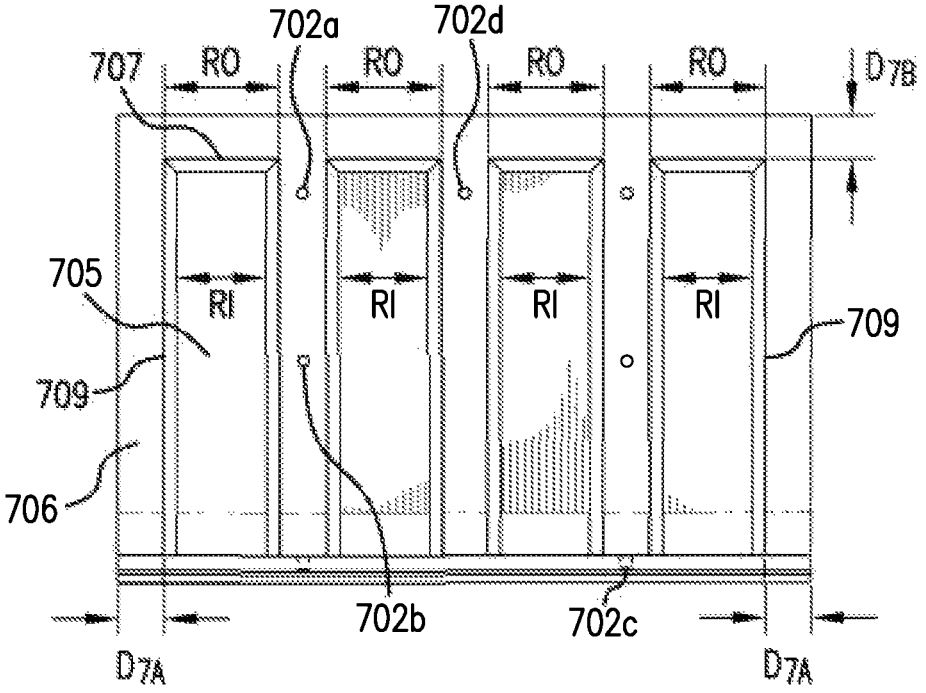
FIG. 6 depicts an elevational view of a stay-in-place fascia form having a plurality of recesses in accordance with the alternate embodiment of the present invention depicted in FIG. 5.
Figure 7:
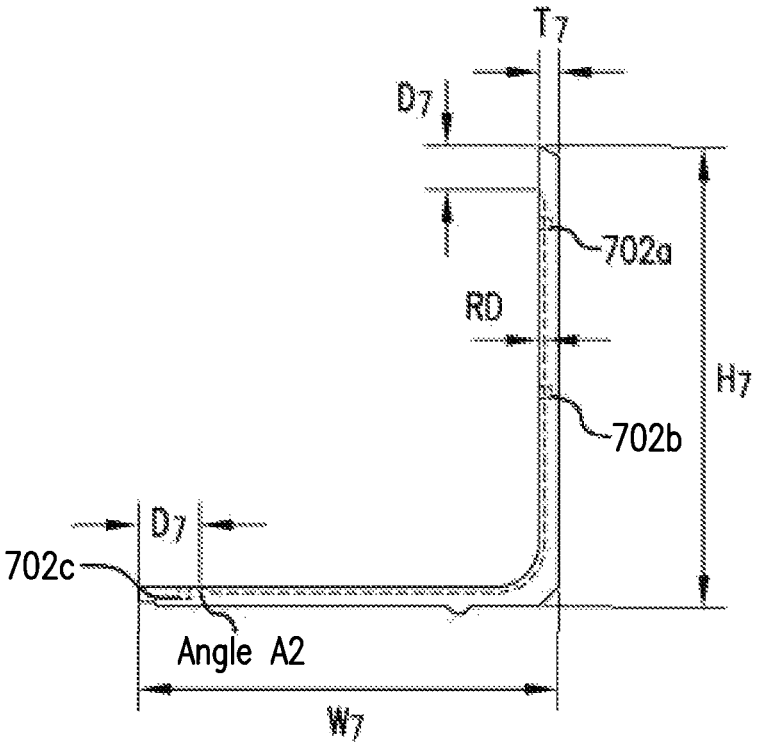
FIG. 7 depicts a side view of a stay-in-place fascia form having a plurality of recesses in accordance with the alternate embodiment of the present invention depicted in FIGS. 5 and 6.

Turning now to FIGS. 5 through 7, depicted are perspective, plan, and side views of stay-in-place fascia form 700 having a plurality of recesses 703 in accordance with one alternate embodiment of the present invention. Recesses 703 decrease the weight of form 700. Although four (4) recesses 703 are illustrated, varying quantities may be substituted without departing from the scope hereof.

In the depicted embodiment, the features of form 700 including, without limitation, inserts 702, interior surface 706, bevel 712, protrusion 716, and rabbet 718 are substantially identical to the equivalent components of form 100, namely, inserts 202, interior surface 106, bevel 212, protrusion 216, and rabbet 218 as discussed above. That is, the only substantial difference between form 100 and form 700 is that the latter includes recesses 703 and the dimensions thereof have been altered to accommodate recesses 703 while maintaining the structural integrity of form 700.

More specifically, height $H_7$ of form 700 is approximately forty one inches (41"), width $W_7$ is approximately thirty seven and one half inches (37½"), and length $L_1$ is approximately sixty inches (60"), however, varied dimensions may be substituted to accommodate, for example, desired size of the structure being built, material strength and geometric boundaries, and/or varying recess sizes and/or quantities.

Form 700 has a thickness $T_7$ of approximately three inches (3"); however, alternate thicknesses may be substituted without departing from the scope of the present invention.

As best seen in the plan view of FIG. 6, recesses 703 have a recess outer width RO of approximately ten inches (10") and a recess inner width RI of approximately eight inches (8"). That is, the interior surfaces surrounding the perimeter of recesses 703 slope inward at an Angle A2 of approximately 45 degrees as such surfaces extend from interior surface 706 of form 700 to interior surface 705 of recess 703. Such angle is best seen in the side view of FIG. 7. Also, the outer latitudinal edges 707 of recesses 703 are located at a distance $D_{7B}$ of approximately four inches from the latitudinal edges of interior surface 706. Similarly, the outer longitudinal edges 709 of the two outermost recesses 703 are located at a distance $D_{7A}$ of approximately four inches from the longitudinal edges of interior surface 706. Recesses 703 have a depth RD of approximately one inch (1"). All of the aforementioned dimensions and angles illustrate one embodiment of the present invention, however, varying dimensions and/or angles may be substituted without departing from the scope hereof.

Figure 8A:
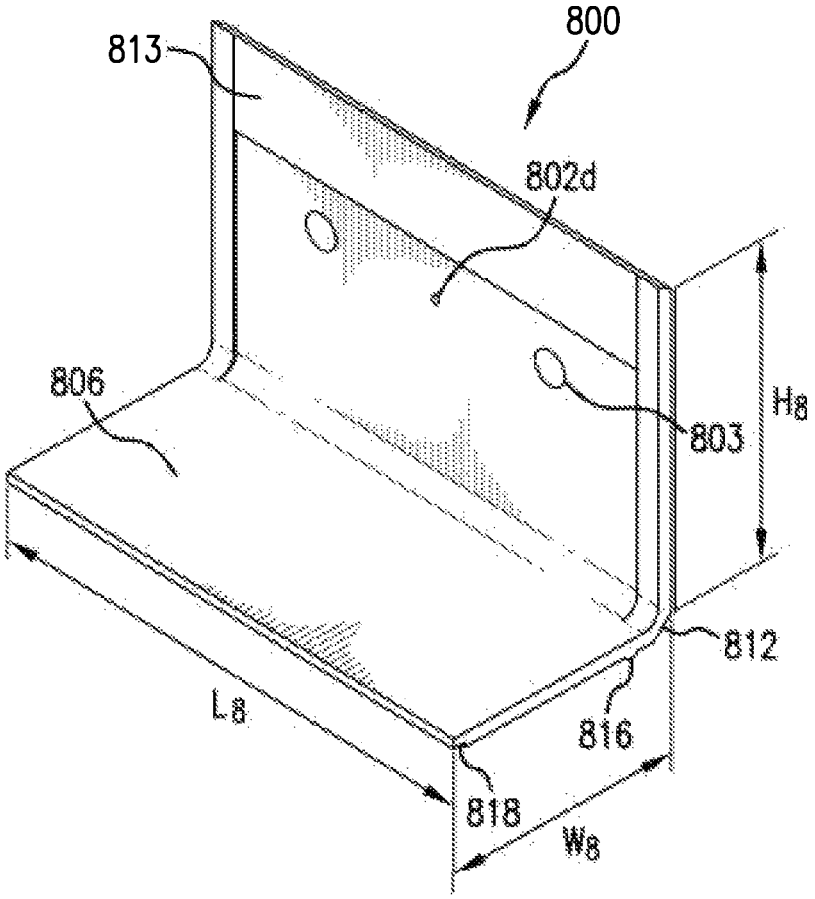
FIG. 8A depicts a perspective view of a stay-in-place fascia form having a plurality of apertures and a recess in accordance with one alternate embodiment of the present invention.
Figure 8B:
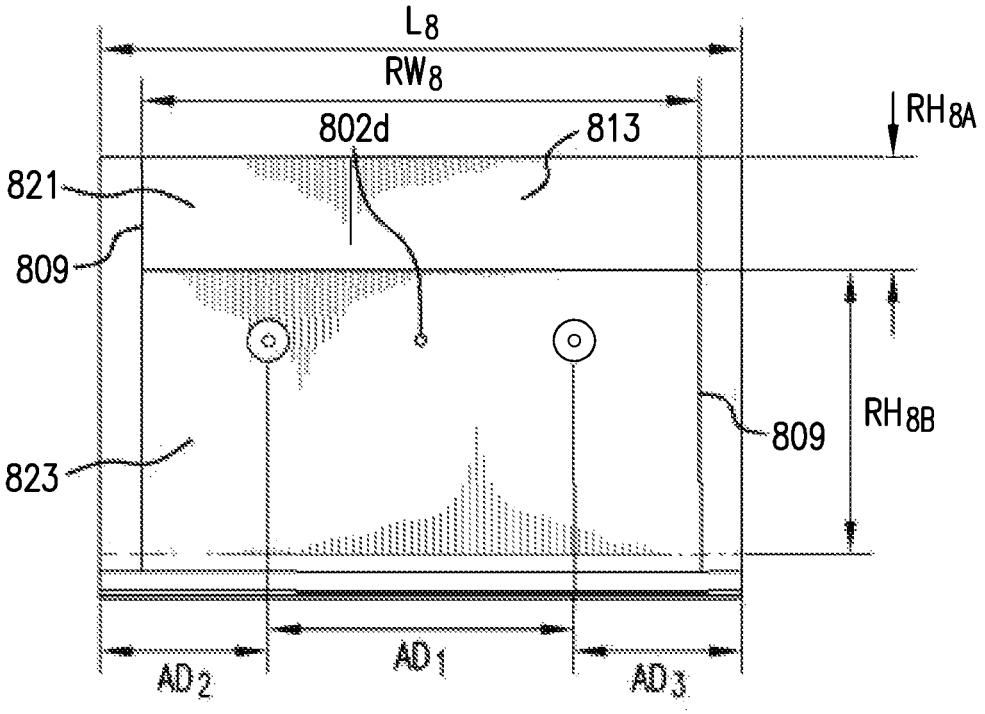
FIG. 8B depicts an elevational view of a stay-in-place fascia form having a plurality of apertures and a recess in accordance with the alternate embodiment of the present invention depicted in FIG. 8A.
Figure 8C:
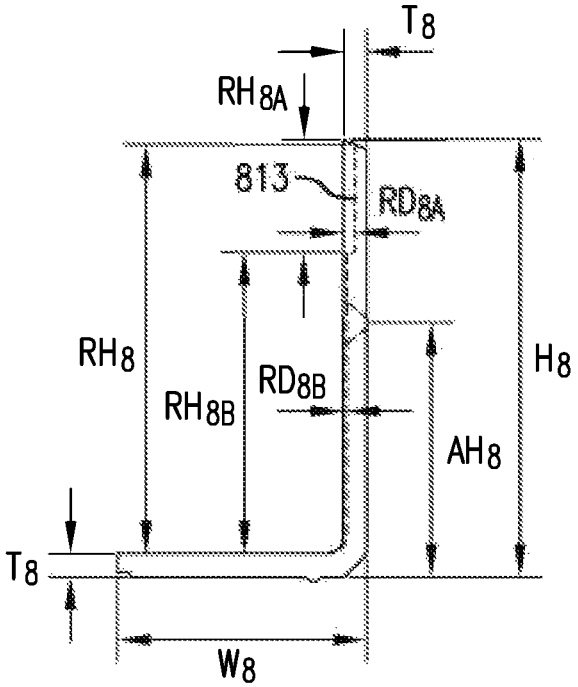
FIG. 8C depicts a side view of a stay-in-place fascia form having a plurality of apertures and a recess in accordance with the alternate embodiment of the present invention depicted in FIGS. 8A and 8B.

Referring next to FIGS. 8A through 8C, depicted are perspective, plan, and side views of stay-in-place fascia form 800 having a pair of apertures 803 and a recess 813 in accordance with one alternate embodiment of the present invention. Apertures 803 allow the form to be secured in place by a coupler such as a rod or the like. That is, a first end of the coupler is coupled to the structural member on which form 800 sits via any one of a plurality of methods known in the art. The second end of the coupler passes through a respective aperture 803. Thereafter, fasteners (e.g., nuts and bolts) may be fastened to the second end of the coupler to prevent or minimize the possibility of the coupler disengaging itself from aperture 803. Although two (2) apertures 803 are illustrated, varying quantities may be substituted without departing from the scope hereof.

Recesses 813 decrease the weight of form 800. Although one (1) substantially rectangular, bi-level recess 813 is illustrated, varying quantities and/or shapes may be substituted without departing from the scope hereof.

In the depicted embodiment, the features of form 800 including, without limitation, insert 802*d*, interior surface 806, bevel 812, protrusion 816, and rabbet 818 are substantially identical to the equivalent components of form 100, namely, insert 202*d*, interior surface 106, bevel 212, protrusion 216, and rabbet 218 as discussed above. That is, the only substantial difference between form 100 and form 800 is that the latter includes recess 813, apertures 803 in lieu of inserts 202, and the dimensions thereof have been altered.

More specifically, the height $H_8$ of form 800 is approximately forty one and 5/16 inches (41 5/16"), the width $W_8$ is approximately thirteen and 3/16 inches (13 3/16"), and the length $L_8$ is approximately sixty inches (60"), however, varied dimensions may be substituted to accommodate, for example, desired size of the structure being built, material strength and geometric boundaries, and/or varying aperture sizes and/or quantities.

Form 800 has a thickness $T_8$ of approximately two inches (2"); however, alternate thicknesses may be substituted without departing from the scope of the present invention.

As best seen in the plan view of FIG. 8B, recess 813 have a recess width $RW_8$ of approximately fifty four inches (54"). The longitudinal edges 809 of recess 813 are located approximately three inches (3") from the longitudinal edges of interior surface 806. Recess 813 has an overall recess height $RH_8$ of approximately thirty nine and 5/16 inches (39 5/16"). Recess 813 includes upper and lower rectangular sections 821 and 823, respectively, having recess depths $RD_{8A}$ and $RD_{8B}$ of approximately one inch (1") and one-half inch (½"), respectively. The width $RW_8$ of upper and lower rectangular sections 821 and 823, respectively, are both approximately fifty four inches (54"). The recess heights $RH_{8A}$ and $RH_{8B}$ are approximately ten and 3/16 inches (10 3/16") and twenty nine and one eighth inches (29⅛"), respectively. All of the aforementioned dimensions and angles illustrate one embodiment of the present invention, however, varying dimensions and/or angles may be substituted without departing from the scope hereof.

In the depicted embodiment, the center point of each aperture 803 is located at a height $AH_8$ of approximately two feet (2') as best seen in FIG. 8C. Additionally, the center points of the two apertures 803 are located at a distance $AD_1$ of approximately thirty inches (30") from each other and at a distance $AD_2$ of approximately fifteen inches (15") from the longitudinal edge of interior surface 806 and a distance $AD_3$ of approximately twelve inches from longitudinal edge 809 of recess 813 as depicted in FIG. 8B. However, varying locations and/or quantities of aperture 803 may be substituted without departing from the scope hereof.

As best seen in FIG. 8C, apertures 803 have a frustoconical shape, however, varying shapes may be substituted without departing from the scope hereof.

Figure 9A:
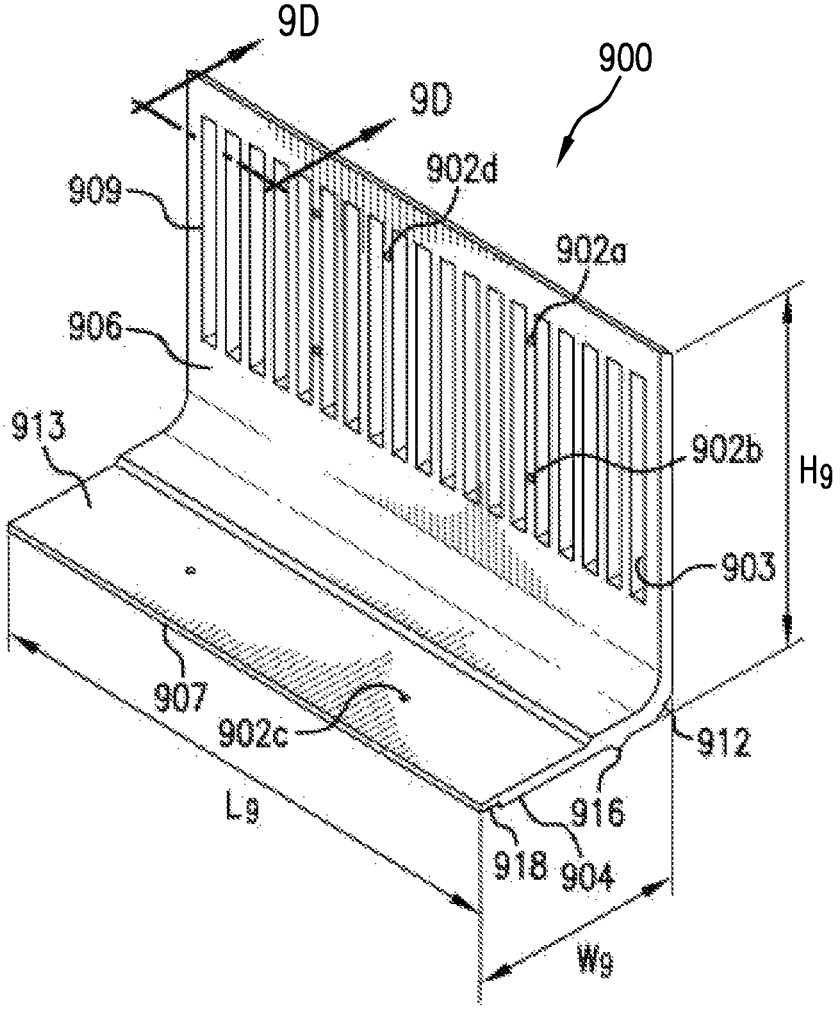
FIG. 9A depicts a perspective view of a stay-in-place fascia form having a plurality of vertical recesses and a horizontal recess in accordance with one alternate embodiment of the present invention.
Figure 9B:
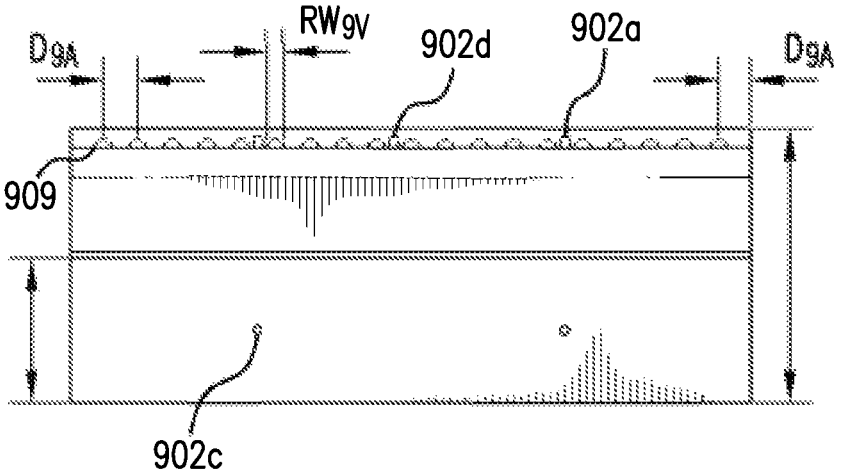
FIG. 9B depicts a plan view of a stay-in-place fascia form having a plurality of vertical recesses and a horizontal recess in accordance with the alternate embodiment of the present invention depicted in FIG. 9A.
Figure 9D:
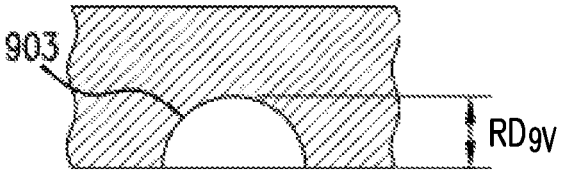
FIG. 9D depicts a cross-sectional view of the vertical recess depicted in FIGS. 9A through 9C as taken along lines 9D-9D of FIG. 9A.
Figure 9C:
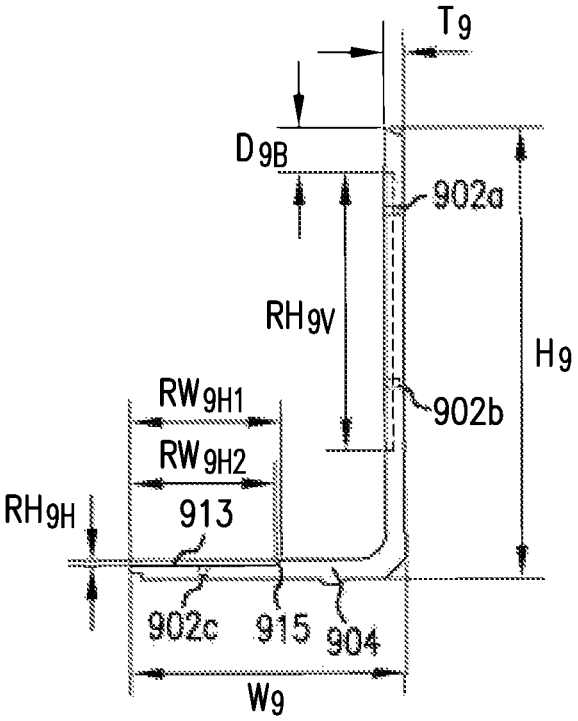
FIG. 9C depicts a side view of a stay-in-place fascia form having a plurality of vertical recesses and a horizontal recess in accordance with the alternate embodiment of the present invention depicted in FIGS. 9A and 9B.

Turning now to FIGS. 9A through 9C, depicted are perspective, plan, side, and cross-sectional views of stay-in-place fascia form 900 having a plurality of vertical recesses 903 and a horizontal recess 913 in accordance with one alternate embodiment of the present invention. Recesses 903 and 913 decrease the weight of form 900. Although nineteen (19) vertical recesses 903 and one (1) horizontal recess 913 are illustrated, varying quantities may be substituted without departing from the scope hereof.

In the depicted embodiment, the features of form 900 including, without limitation, inserts 902, horizontal component 904, interior surface 906, bevel 912, protrusion 916, and rabbet 918 are substantially identical to the equivalent components of form 100, namely, inserts 202, horizontal component 104, interior surface 106, bevel 212, protrusion 216, and rabbet 218 as discussed above. That is, the only substantial difference between form 100 and form 900 is that the latter includes vertical recesses 903, horizontal recess 913, and the dimensions thereof have been altered to accommodate recesses 903 and 913 while maintaining the structural integrity of form 900.

More specifically, height $H_9$ of form 900 is approximately forty one inches and five sixteenths inches (41 5/16"), width $W_9$ is approximately twenty five inches (25"), and length $L_9$ is approximately sixty inches (60"), however, varied dimensions may be substituted to accommodate, for example, desired size of the structure being built, material strength and geometric boundaries, and/or varying recess sizes and/or quantities.

Form 900 has a thickness $T_9$ of approximately two inches (2"); however, alternate thicknesses may be substituted without departing from the scope of the present invention.

As best seen in the plan view of FIG. 9B, vertical recesses 903 have a recess width $RW_{9V}$ of approximately three quarters of an inch (¾") and a semicircular cross section, the latter of which is best seen in the cross-sectional view of FIG. 9D. The longitudinal centerlines of each vertical recess 903 are located equidistantly at a distance $D_{9A}$ of approximately three inches (3") from all other recess longitudinal centerlines and the longitudinal edges of interior surface 906. Also, the outer latitudinal edges 907 of vertical recesses 903 are located at a distance $D_{9B}$ of approximately four inches from the latitudinal edges of interior surface 906. Similarly, as also stated above, the outer longitudinal edges 909 of the two outermost recesses 903 are located at a distance $D_{9A}$ of approximately four inches from the longitudinal edges of interior surface 906. Recesses 703 have a depth $RD_{9V}$ of approximately three eights of an inch (⅜") and a height $RH_{9V}$ of approximately twenty five and one-sixteenth inches (25 1/16"). All of the aforementioned dimensions and angles illustrate one embodiment of the present invention, however, varying dimensions and/or angles may be substituted without departing from the scope hereof.

As best seen in the perspective and side views of FIGS. 9A and 9C, recess 913 is located in horizontal component 904 and has a length approximately equivalent to the length $L_9$ of form 900. The width of recess 913 extends from the distal longitudinal edge 907 of horizontal component 904 inward at a width $RW_{9H1}$ of approximately fourteen and one quarter inches (14¼"). Recess side surface 915 is angled downward as it extends outward at an angle of approximately 45 degrees (45°), thereby decreasing the width of recess 913 to a width $RW_{9H2}$ of approximately thirteen and three quarters inches (13¾") on its bottommost surface. The recess height $RH_{9H}$ is one half inch (½"). All of the aforementioned dimensions and angles illustrate one embodiment of the present invention, however, varying dimensions and/or angles may be substituted without departing from the scope hereof.

Turning next to FIGS. 10A through 10G, depicted is an exemplary alternate stay-in-place form 1000 in accordance with one alternate embodiment of the present invention. Form 1000 is mounted parallel to, and tied atop, a structural member 302, as discussed hereinabove. This exemplary form 1000 is utilized as a form for supporting uncured concrete, and, after the concrete has cured, form 1000 remains an integral part of the structure formed thereby. This exemplary form 1000 is intended for uses similar to the uses of form 100, and provides similar benefits to form 100, as described in greater detail above.

Similar to form 100, form 1000 is a relatively thin, substantially L-shaped panel that includes vertical component 1002 and horizontal component 1004. In the depicted embodiment, vertical component 1002 is located substantially perpendicular to horizontal component 1004, however, alternate orientations may be substituted.

Vertical component 1002 and the proximal portion of horizontal component 1004 have thicknesses $T_1$ of approximately three inches (3"). The thickness $T_2$ of the distal end of horizontal component is thicker (i.e., three and seven thirty seconds (3 7/32) inches), however, alternate thicknesses may be substituted without departing from the scope of the present invention. That is, in the depicted embodiment, the thickness of horizontal component 1004 gradually increases starting at its intersection with joining component inwardly facing surface 1234, however, alternate sizing and configurations may be substituted without departing from the scope hereof.

The height $H_{1000}$ of form 1000 is approximately forty inches (40"), the width $W_{1000}$ is approximately fifteen and thirty-five hundredths inches (15.35"), and the length $L_{1000}$ is approximately sixty inches (60"), however, varied dimensions may be substituted to accommodate, for example, desired size of the structure being built as well as material strength and geometric boundaries.

In the depicted embodiment, the features of form 1000 including, without limitation, insert 1202*d*, vertical component interior surface 1006, bevel 1212, vertical component upwardly facing surface 1222, horizontal component upwardly facing surface 1008, vertical component inwardly facing surface 1110, joining component inwardly facing surface 1234, joining component 1210, ornamental features 1240, horizontal component downwardly facing surface 1114, and protrusion 1216 are substantially identical to the equivalent components of form 100, namely, insert 202*d*, interior surface 106, bevel 212, upwardly facing surface 222, upwardly facing surface 108, inwardly facing surface 110, inwardly facing surface 234, joining component 210, ornamental features 240, downwardly facing surface 114, and protrusion 216 as discussed above with the following exceptions.

Figure 10A:
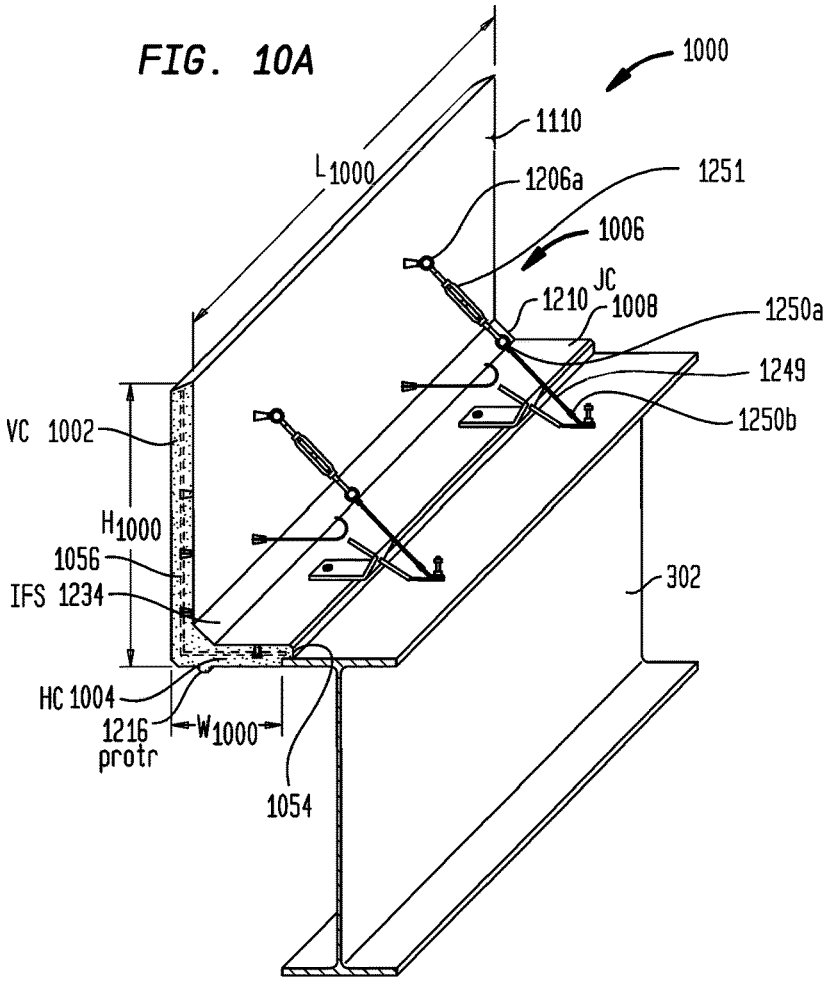
FIG. 10A depicts a perspective view of a form in accordance with one embodiment of the present invention.

Rabbet 1218 is substantially identical to rabbet 218 of form 100 with the exception of top and side surfaces 1050 and 1052, respectively. More specifically, in the embodiment of the present invention depicted in FIGS. 10A through 10K, as best seen in FIG. 10E, the rabbet 1218 includes a rabbet 1218 defined by top and side surfaces 1050 and 1052, respectively. Side surface 1052 tapers inwardly as it extends downwardly at an angle of approximately fifteen and one half (15.5) degrees beyond vertical, and top surface 1050 tapers upwardly as it extends distally away from side surface 1052 at an angle of approximately fifteen and one half (15.5) degrees above horizontal. Consequently, the top and side surfaces 1050 and 1052 are located at an angle of greater than ninety degrees relative to each other. Also, each of top and side surfaces 1050 and 1052, respectively, are located at an angle of greater than ninety degrees relative to the vertical and horizontal planes 1059 and 1057, respectively, of the innermost point 1055 of the rabbet 1218. That is, top surface 1050 is greater than ninety degrees relative to the vertical plane 1059 of point 1055, and side 1052 is greater than ninety degrees relative to the horizontal plane 1057 of innermost point 1055. However, alternate angles and/or configurations for the sides of rabbet 1218 may be substituted without departing from the scope hereof. Rabbet 1218 may also have varying cross-sections without departing from the scope hereof, including, without limitation, a square cross-section.

Also, in the depicted embodiment of the present invention, the upper corner of a distal end of horizontal component 1004 is in the form of chamfered edge 1214 rather than the rounded edge 214 shown for form 100. Further, chamfered edge 1214 is chamfered at an angle of approximately forty-five degrees relative to horizontal component upwardly facing surface 1008 and horizontal component distal vertical surface 1054, however, alternate angles may be substituted without departing from the scope hereof. However, alternate configurations and/or shapes for this edge may be substituted including, without limitation a squared edge, a rounded edge or edge treatment.

Figure 10B:
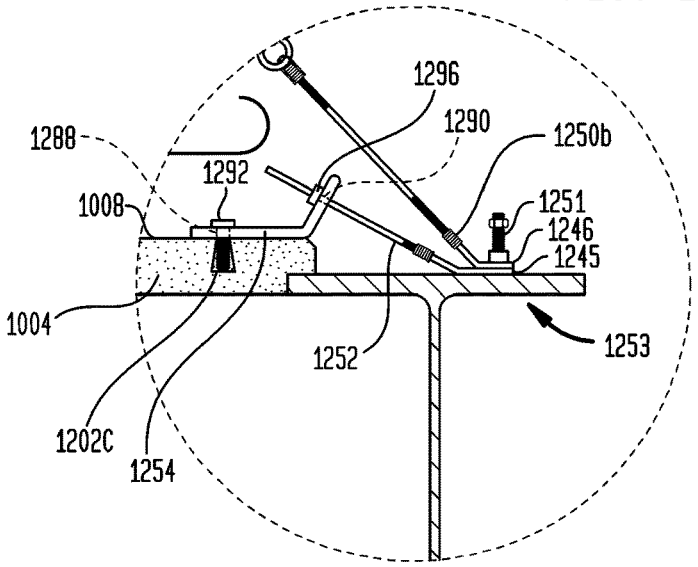
FIG. 10B depicts a side view of a primary support in use with the form of FIG. 10A in accordance with one embodiment of the present invention.
Figure 10C:
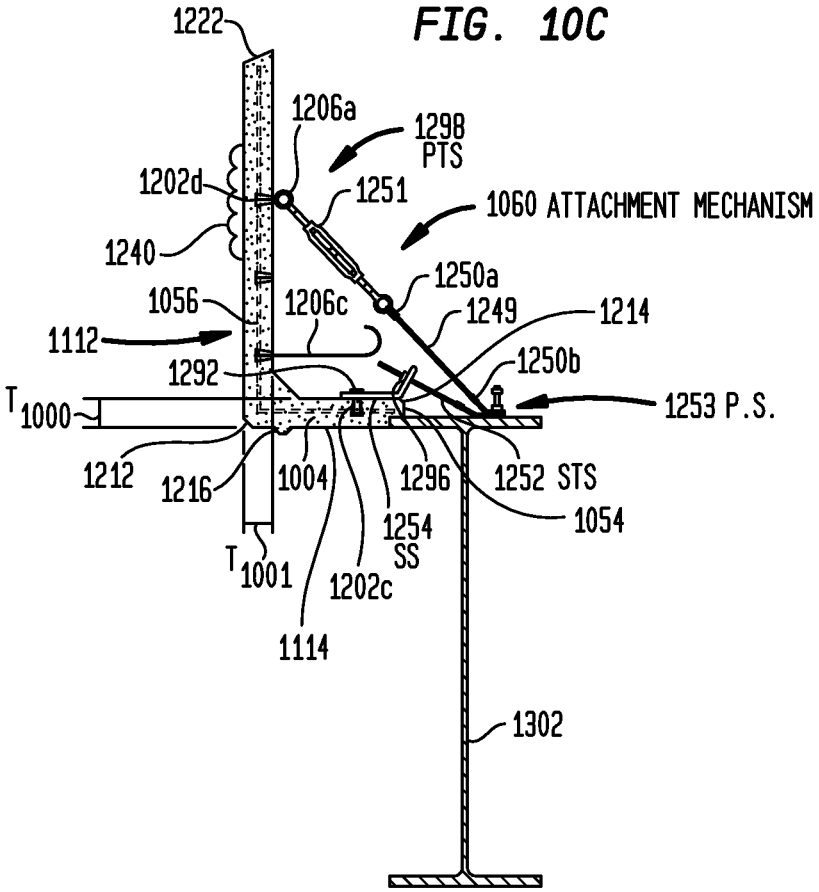
FIG. 10C depicts a side view of the form of FIG. 10A positioned atop the outer edge of a structural member in accordance with one embodiment of the present invention.
Figure 10D:
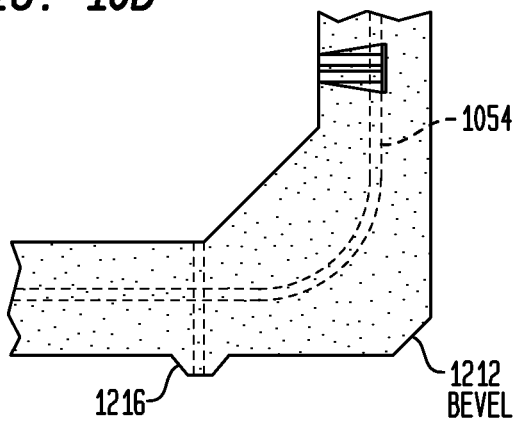
FIG. 10D depicts an enlarged side view of the intersection of the horizontal and vertical components of the form of FIG. 10A in accordance with one embodiment of the present invention.
Figure 10E:
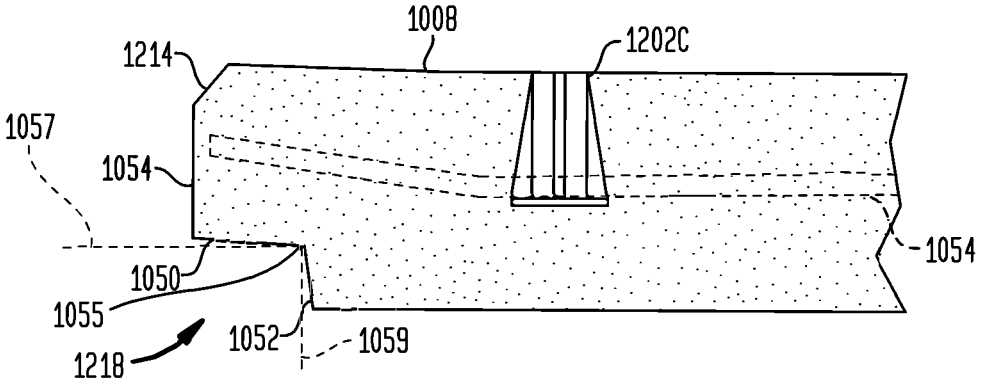
FIG. 10E depicts an enlarged side view of the distal end of the horizontal component of the form of FIG. 10A in accordance with one embodiment of the present invention.
Figure 10F:
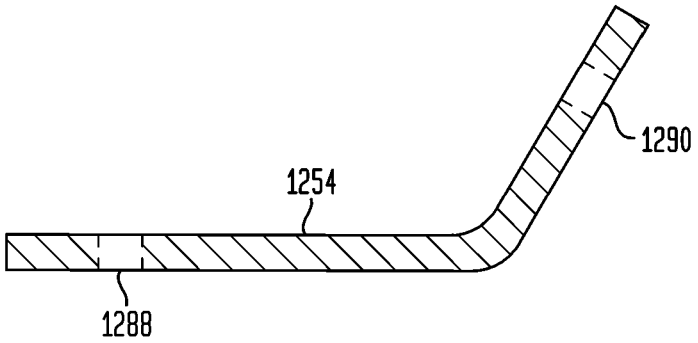
FIG. 10F depicts a side view of a secondary support for use with the form of FIG. 10A in accordance with one embodiment of the present invention.
Figure 10G:
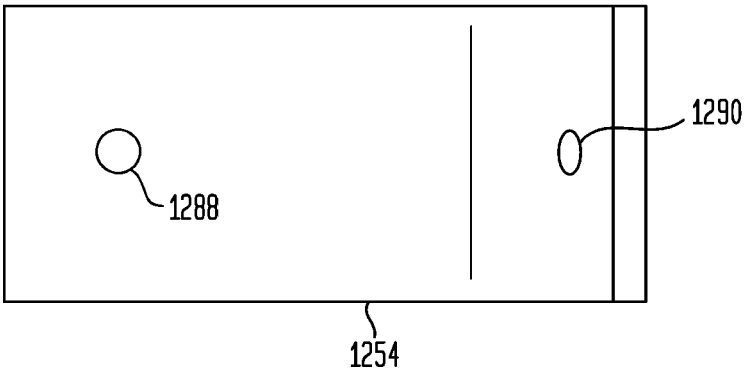
FIG. 10G depicts a top view of a secondary support for use with the form of FIG. 10A in accordance with one embodiment of the present invention.
Figure 10H:
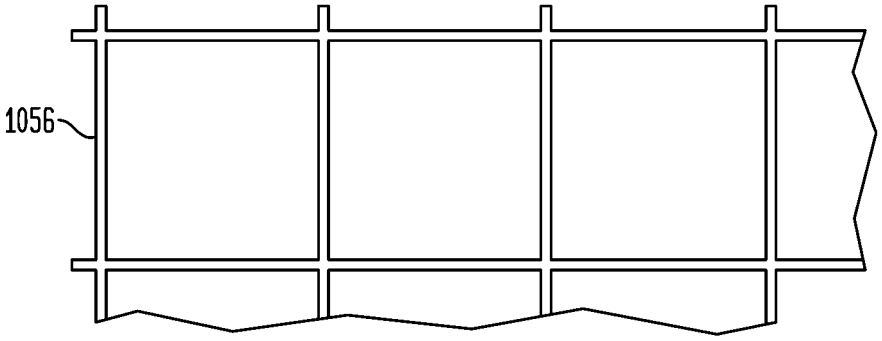
FIG. 10H depicts a top view of an interior reinforcement for use with the form of FIG. 10A in accordance with one embodiment of the present invention.

Additionally, form 1000 includes internal reinforcement 1056 as depicted in FIG. 10H and similar to internal reinforcement 242 of form 100. In the depicted embodiment, internal support 1056 is a four (4) inch by four (4) inch grid of welded wire mesh W4.0 by W4.0 Grade 60 Galvanized Steel ASTM Designation A 185 A 641, located internal to form 1000 as depicted in dashed lines in FIGS. 10A and 10C through 10E. As seen in FIG. 10E, internal reinforcement 1056 is substantially horizontal internal to horizontal component 1004 until a point slightly distal to insert 1202*c*, at which point it angles upwardly as it approaches the distal end of substantially horizontal component 1004 at an angle that retains internal reinforcement 1056 at the vertical midpoint of horizontal component 1004. However, alternate angles, internal reinforcements and/or internal reinforcement configurations may be substituted without departing from the scope hereof Or, internal reinforcement may be omitted partially or entirely without departing from the scope hereof.

Further, in form 1000, similar to form 100, the inserts 1202 of the substantially horizontal component 1004 and the substantially vertical component 1002 facilitate attachment of form 1000 to an existing structural member 302. However, the attachment mechanism 1060 utilized in conjunction with such form attachments differ.

More specifically, in the depicted embodiment, attachment mechanism 1060 includes, primary support 1253, secondary support 1254, primary tie system 1298, and secondary tie system 1252. In the depicted embodiment, primary tie system 1298 includes, rod 1249, rod insert 1250*a*, adjustable fastener 1251, and form attachment 1206*a* which are coupled to form 1000 and the top of structural member 302 diagonally at an angle of approximately forty-five (45) degrees, however alternate angles may be substituted without departing from the scope hereof.

In the depicted embodiment, the primary tie system 1298 includes at least one coil rod 1249 such as an inline, Dayton Superior B12 coil rod made of a rigid material such as steel etc. having a one-half (½) inch diameter capable of withstanding a load of at least 18,000 pounds. One end of rod 1249 is connected to rod insert 1250*b* of primary support 1253 and the other end of rod 1249 is connected to rod insert 1250*a*. The rod inserts 1250*a* and 1250*b* are constructed of a rigid material such as steel and the like and have a diameter of one half (½) inch and length of six (6) inches. In the depicted embodiment, these rod inserts are Dayton Superior one half inch (½") diameter by six inch (6") length B16 coil loop inserts.

Rod insert 1250*a* is connected to form 1000 by means of an adjustable fastener 1251 and form attachment 1206*a*. In the depicted embodiment, adjustable fastener 1251 is a turnbuckle with jaw ends made of a rigid material such as steel etc. and having a three quarter (¾) inch diameter, and form attachment 1206*a* is in the form of a one half (½) inch diameter shoulder eyebolt (also made of a rigid metal such as steel etc.) affixed to form 1000 by insertion into insert 1202*d*. Adjustable fastener 1251 allows the spacing connection between form attachment 1206*a* and rod 1249 to be fine-tuned by spinning it in either direction to engage the threads, which may be used, for example, to bring the form into a plumb position. This may be done via a wrench or the like.

Rod insert 1250*b* is integral to primary support 1253 as shown in FIG. 10B. In the depicted embodiment, primary support 1253 includes two substantially rectangular bent plates, namely, upper and lower plates 1246 and 1245, respectively. The downwardly facing surface 1280 of the proximal end of upper plate 1246 is welded to the upwardly facing surface 1282 of the proximal end of lower plate 1245. However, alternate embodiments are envisioned in which the welding is eliminated and two separate plates are utilized and are held together via a fastener such as fastener 1251.

Upper and lower plates 1246 and 1245, respectively, have substantially rectangular shapes and are made of a rigid metal such as, but not limited to, steel. In the depicted embodiment, upper bent plate 1246 is four (4) inches wide, ten (10) inches long, and one half (½) inch thick, and it is bent at an angle of approximately forty-five (45) degrees relative to its longitudinal axis to receive and accommodate diagonally positioned primary tie system 1298, however alternate angles may be substituted without departing from the scope hereof Lower plate 1245 is also substantially rectangular and made of a rigid material such as, but not limited to, ½-inch thick steel and having dimensions of two and one sixteenth (2 1/16) inches wide and seven and one quarter (7¼) inches long. In the depicted embodiment, lower plate 1245 is bent at an angle of approximately twenty-two and one half (22½) degrees from its longitudinal axis to receive and accommodate the position of secondary tie system 1252, which in the depicted embodiment is a secondary support rod. However alternate angles may be substituted without departing from the scope hereof.

Figure 10I:
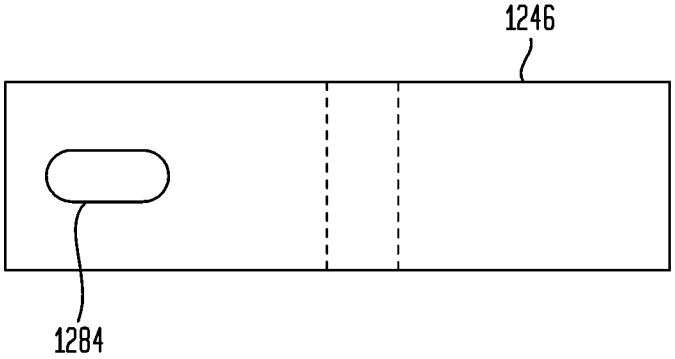
FIG. 10I depicts a top view of the upper plate of the primary support of FIG. 10B.

As seen in the top view of FIG. 10I, upper plate 1246 includes an aperture 1284 at its proximal end. As seen in FIG. 10F, similarly, lower plate 1245 includes an aperture 1288 at its proximal end. In the depicted embodiment, as seen in FIG. 10B, rod insert 1250*b* is connected to a distal end of upper plate 1246 by means of a fillet weld, and rod insert 1241 is connected to a distal end of lower plate 1245 by means of a fillet weld.

Primary support 1253 is coupled to structural member 302 by means of fastener 1251. In the depicted embodiment, fastener 1251 is a threaded shear stud being made of a rigid material such as steel and the like welded to structural member 302. The apertures of upper and lower plates 1246 and 1245, respectively, are passed over the stud and a nut compatible with the threaded end of the stud is fastened atop upper plate 1246 to hold primary support 1253 in place relative to structural member 302 therewith. However, alternate sizes for upper bent plate 1246 and lower bent plate 1245, and alternate methods of attaching such plates to the structural member 302, to rod insert 1250*b*, and to each other may be substituted without departing from the scope hereof.

In the depicted embodiment, secondary tie system 1252 may be a coil rod similar to rod 1249 of primary tie system 1298, however, alternate ties or supports may be substituted.

In the depicted embodiment, as shown in FIG. 10F, secondary support 1254 is substantially rectangular, made of a rigid metal such as steel and has two apertures 1288 and 1290 at either end. In the depicted embodiment, secondary support 1254 is bent at an angle of approximately twenty-two and one half (22½) degrees from its longitudinal axis to receive and accommodate the position of secondary tie system 1252, however alternate angles may be substituted without departing from the scope hereof.

Secondary support 1254 is coupled to the upwardly facing surface 1008 of horizontal member 1004 via a fastener 1292 passing through aperture 1288 and into insert 1202*c*. For example, fastener 1292 may be a one half (½) inch diameter bolt.

Secondary tie system 1252 is attached at a first end by insertion and/or threading of secondary tie system into rod insert 1241. The second end of secondary tie system 1252 is passed through an aperture 1290 in secondary support 1254 and a retention mechanism 1292 is threaded onto the second end of secondary tie system 1252 until it is in contact with secondary support 1254, thereby holding secondary tie system 1252 in place. Retention mechanism may be a nut or the like.

Although the depicted attachment mechanism 1060 includes, primary support 1253, secondary support 1254, primary tie system 1298, and secondary tie system 1252, alternate attachment mechanisms 1060 are envisioned. For example, secondary support 1254 and secondary tie system 1252 may be omitted. Or, primary support 1253 and primary tie system 1298 may be omitted. Alternatively, various components of the attachment mechanism 1060 may be substituted for other components having equivalent functionality. And alternate methods of coupling the components of attachment mechanism 1060 may be substituted without departing from the scope hereof.

After form 1000 is tied in place, it contains the work area as soon as it is installed as discussed, which minimizes or eliminates fall hazards, thereby eliminating the time, costs (e.g., labor costs, removal costs, disposal costs, etc.), and downtime associated with installation of safety measures that are typically required (e.g., formwork, scaffolding, road closure, etc.) to contain the work area. The exposed ties having a load rating well-over that required to temporarily anchor fall protection life lines. Minimal or zero excess materials are needed to contain the work area since the form performs this task while also remaining in place after construction to become part of the structure being built. Also, the disruption of traffic or other environmental considerations beneath the structure being built is minimized as all work can be safely performed from atop the structure.

After the form 1000 is installed as depicted in FIG. 10C, the process of installing the deck and barrier may proceed as described above with respect to FIGS. 3A through 3I with the following modifications.

After the concrete is poured and cured, the portion of attachment mechanism 1060 located above the deck which is not going to be encased in the barrier may optionally be removed from the form 1000 via dismantling turnbuckle with jaw ends 1251 from form attachment 1206*a* on one end and rod insert 1250*a* on the opposite end. The rod insert 1250*a* and form attachment 1206*a* may need to be cut away from the newly formed deck by means of a grinder and the like. Alternatively, they may be left in place and encased in the overall deck and barrier combination. The encasement of form 1000 facilitates the ability of form 1000 to accommodate the shear and moment forces placed thereupon by the weight of the overall deck and barrier.

Figure 10J:
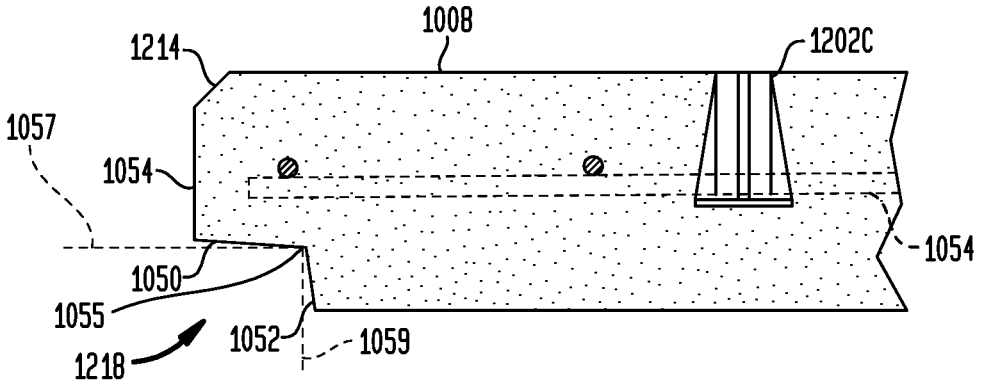
FIG. 10J depicts an enlarged side view of the distal end of the horizontal component of the form of FIG. 10A having an alternate distal end and upwardly facing surface in accordance with one embodiment of the present invention.
Figure 10K:
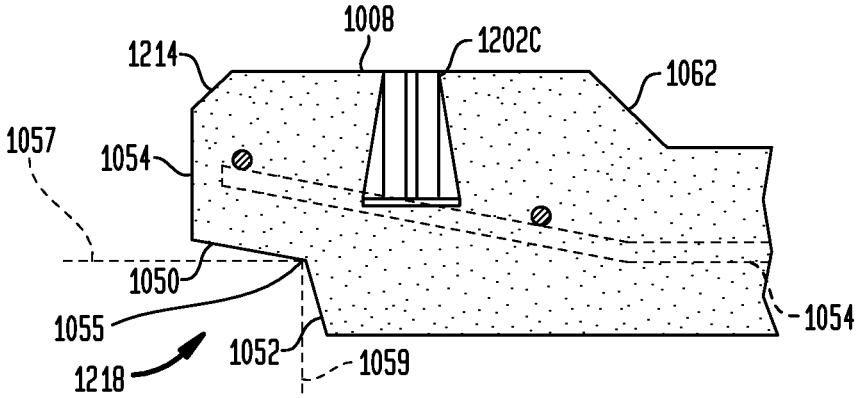
FIG. 10K depicts an enlarged side view of the distal end of the horizontal component of the form of FIG. 10A having an alternate distal end that includes a thickened distal end in accordance with one embodiment of the present invention.

Referring now to FIG. 10J, depicted is an enlarged side view of the distal end of the horizontal component of the form of FIG. 10A having an alternate distal end in which the upwardly facing surface 1008 angles upwardly as it extends outwardly and away from joining component 1210 at a greater angle than that shown in FIGS. 10A through 10I. By angling the height of upwardly facing surface 1008 at a greater angle relative to joining component 1210, the thickness of the distal end of horizontal component 1004 is increased as compared to the distal end of the horizontal component shown in FIGS. 10A through 10I. A thicker distal end may be desirable, for example, when a structural support such as structural support 1302 has a varied flange thickness (i.e., the bottom of the top flange remains constant while the top of the flange steps up or down). Since standard construction practice is to hold the bottom of form 1000 even with the bottom of the top flange, the edge of the form 1000 needs to be thickened so that the notch can be blocked out during casting in essence putting a step in form 1000 along its edge to mimic the geometry of the structural support 1302 while maintaining at least one and a half inches (1¼") of concrete cover above the notch area to take the load. FIG. 10J depicts one method of accounting for such concrete cover. Another example is shown in FIG. 10K in which the distal end is thickened but, in lieu of a continuously upwardly angled slope to upwardly facing surface 1008, form 1000 includes a transitional surface 1062 that transitions from the upwardly facing surface 1008 of the thickened distal end to the area proximal to the thickened end at an angle of approximately forty five degrees. In this manner, the distal end of horizontal component 1004 is thickened while maintaining the proximal portion of horizontal component at a thickness more similar to that of the joining component 1210 interface. However, alternate methods of thickening the distal end of horizontal component 1004 may be substituted without departing from the scope hereof.

Turning now to FIGS. 11A through 11F, depicted is yet another exemplary alternate stay-in-place form 11000 in accordance with an alternate embodiment of the present invention, the form mounted parallel to, and tied atop, a concrete structural member 11102 having a substantially rectangular cross-section. This exemplary form 11000 is utilized as a form for supporting uncured concrete, and, after the concrete has cured, form 11000 remains an integral part of the structure formed thereby. This exemplary form 11000 is intended for uses similar to the uses of forms 100 and 1000, and provides similar benefits to forms 100 and 1000, as described in greater detail above.

Similar to form 1000, form 11000 is a relatively thin, substantially L-shaped panel that includes vertical component 11002 and an extremely minimal horizontal component 11004. In the depicted embodiment, vertical component 11002 is located substantially perpendicular to horizontal component 11004, however, alternate orientations may be substituted.

Vertical component 11002 has a thickness $T_{1100}$ of approximately two and one quarter inches (2¼"). The thickness $T_{1101}$ of horizontal component 1104 is thicker (i.e., approximately three (3) inches), however, alternate thicknesses may be substituted without departing from the scope of the present invention.

In the depicted embodiment, the features of form 11000 including, without limitation, insert 11202, bevel 11212, vertical component upwardly facing surface 11222, form inwardly facing surface 11010, joining component inwardly facing surface 11234, joining component 11210, ornamental feature 11240, downwardly facing surface 11114, and rabbet 11218 are substantially identical to the equivalent components of form 1000, namely, insert 1202, bevel 1212, upwardly facing surface 1222, inwardly facing surface 1010, inwardly facing surface 1234, joining component 1210, ornamental feature 1240, downwardly facing surface 1114, and rabbet 1218 as discussed above with the following exceptions.

Figure 11A:
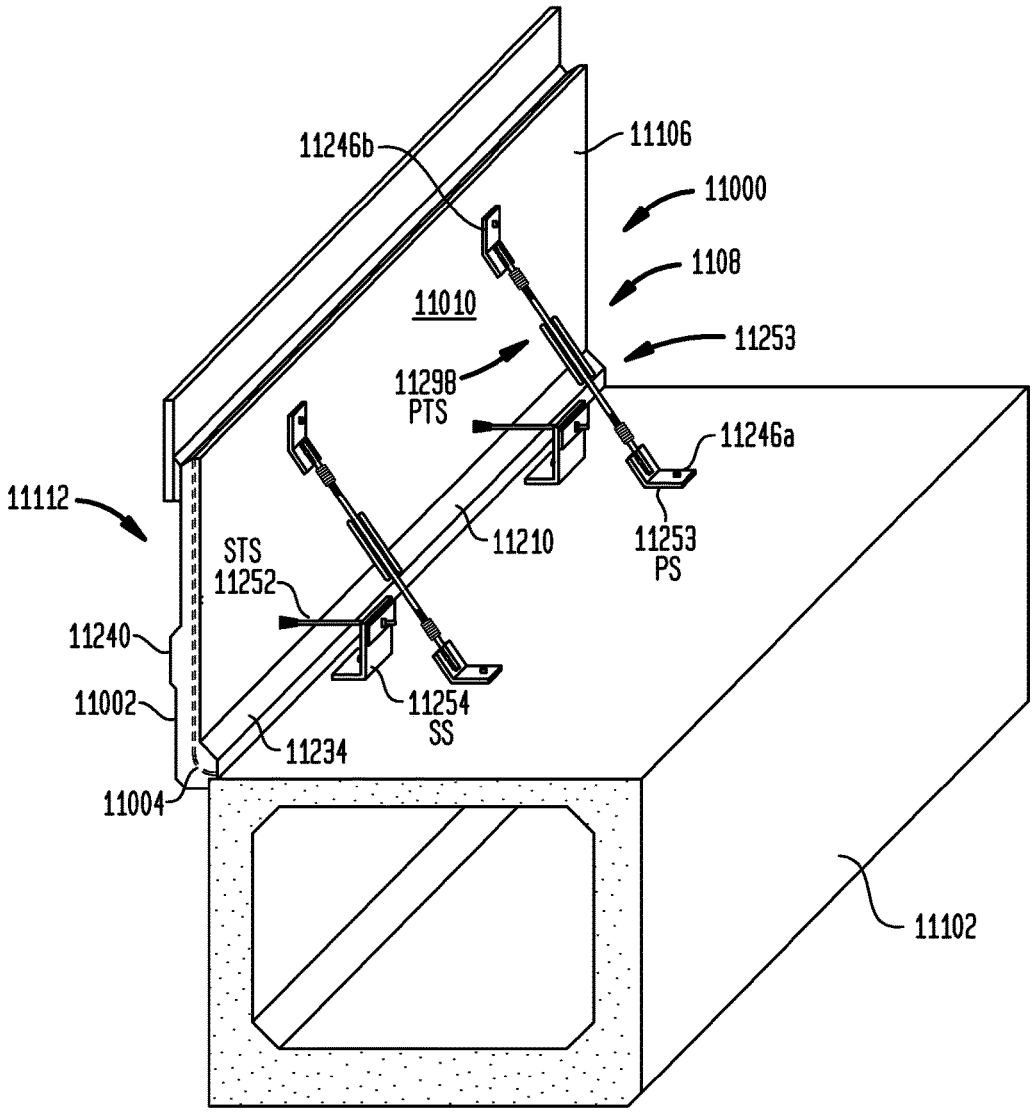
FIG. 11A depicts a perspective view of an alternate form mounted atop a concrete structural member in accordance with one embodiment of the present invention.
Figure 11B:
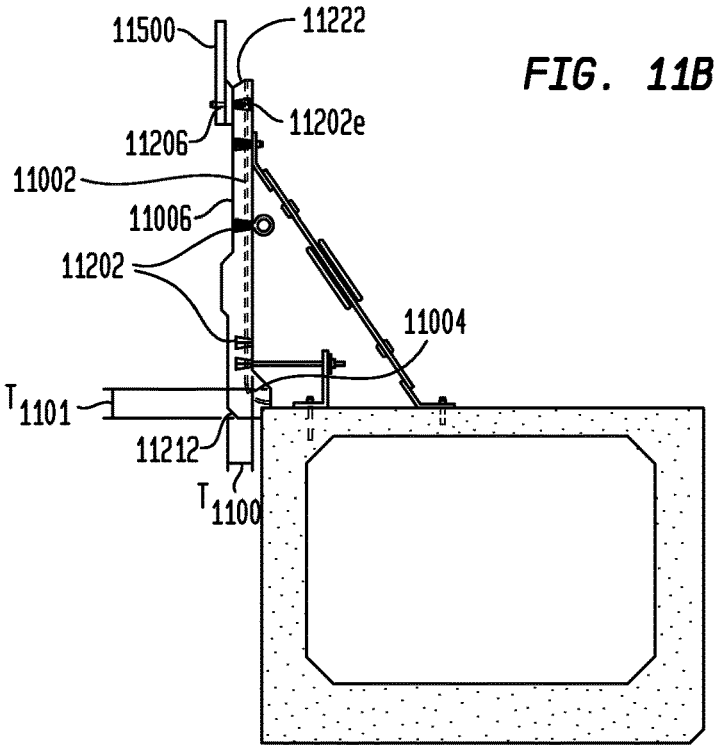
FIG. 11B depicts a side view of the alternate form of FIG. 11A in accordance with one embodiment of the present invention.
Figure 11C:
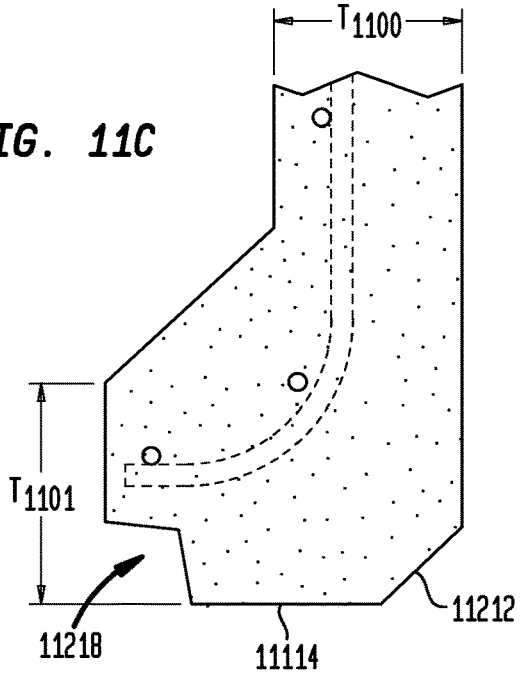
FIG. 11C depicts an enlarged side view of the intersection of the horizontal and vertical components of the form of FIG. 11A in accordance with one embodiment of the present invention.
Figure 11D:
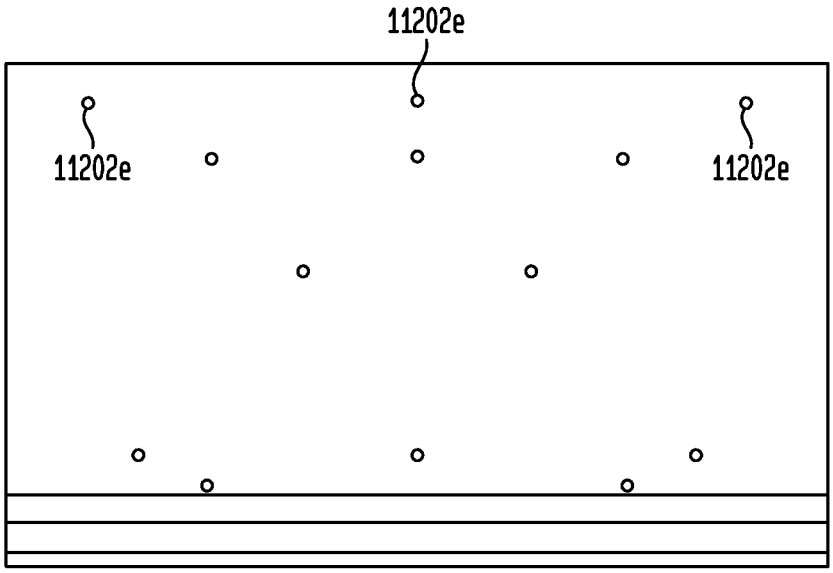
FIG. 11D depicts a plan view of the alternate form of FIG. 11A in accordance with one embodiment of the present invention.
Figure 11E:
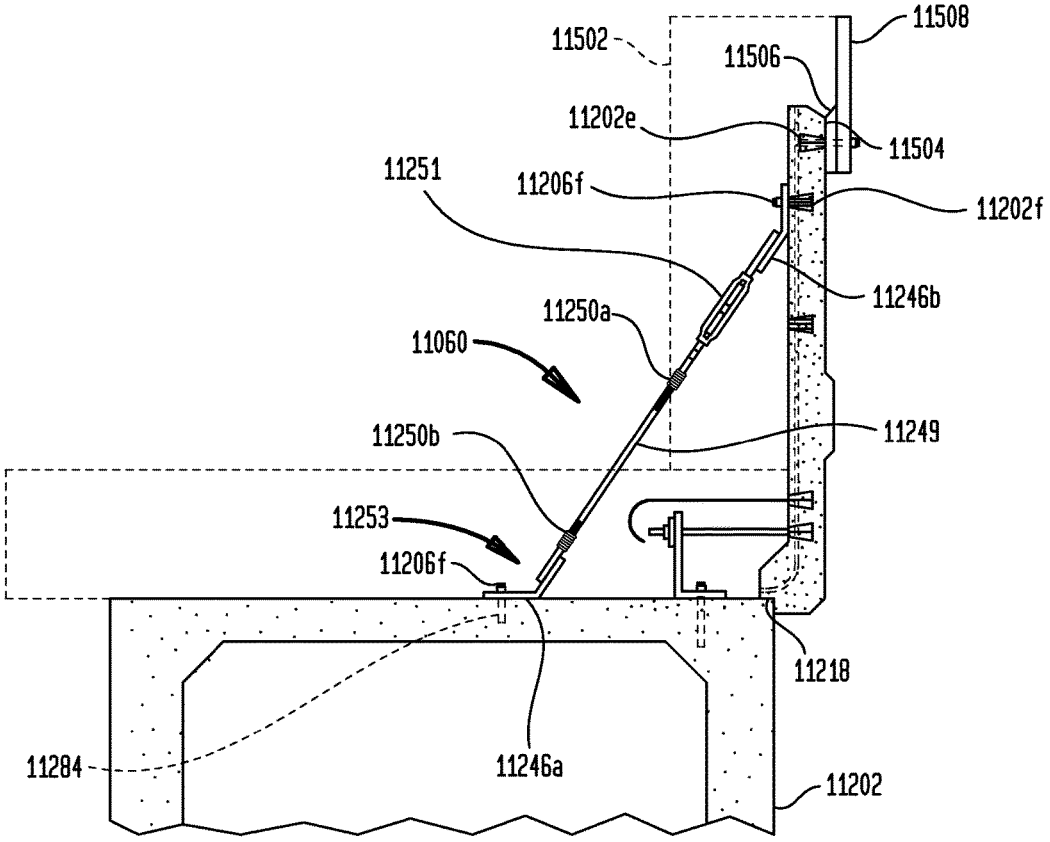
FIG. 11E depicts a side view of the alternate form of FIG. 11A mounted atop a concrete structural member in accordance with one embodiment of the present invention.

In the depicted embodiment, as best seen in FIG. 11B, form 11000 includes a plurality of inserts 11202*e* recessed in the upper edge of vertical component outwardly facing surface 11006 of vertical component 11002. Inserts 11202*e* are similar to inserts 202 as described in greater detail herein with regards to form 100. In the depicted embodiment, as depicted in FIG. 11D, inserts 11202*e* are located approximately two (2) feet from each other horizontally and approximately six (6) inches from the lateral sides of form 11000. Inserts 11202*e* facilitate the attachment of an external, removable form such as secondary form 11500 that allows the concrete barrier 11502 to be poured over the top of form 11000 as shown in FIG. 11E. Removable secondary form 11500 may be coupled to form 11000 with any form attachment 11206 compatible with insert 11202*e* including, without limitation, bolts or the like. In the depicted embodiment, removable form 11500 has a substantially rectangular body 11508 with a substantially rectangular cross section as well as a lower band 11504 coupled to the bottom interior of the rectangular body. Lower band 11504 has an angled upwardly facing surface 11506 that extends upwardly at an angle of approximately forty five (45) degrees as it extends outwardly away from form 11000. The innermost, bottommost edge of band upwardly facing surface 11506 is in contact with the outermost, bottommost edge of primary form upwardly facing surface 11222 such that a channel is formed therebetween. When this channel is filled with concrete and such concrete cures, a concrete decorative panel is formed atop the outwardly facing surface of form 11000 for aesthetic purposes. However alternately configured secondary forms and form liners may be substituted without departing from the scope hereof including, without limitation, forms of different materials and different shapes.

Similar to form 1000, form 11000 is secured in place to concrete structural member 11102 via an attachment mechanism 11060 that includes primary supports 11253, secondary supports 11254, primary tie system 11298, and secondary tie system 11252. However, such supports vary in some manners from those utilized for form 11000.

First, primary support 11253 utilized with form 11000 includes a single plate 11246*a* only and rather than upper and lower plates. The angle of the bend in plate 11246 may be adjusted as needed to accommodate the angle at which the primary tie system 11298 will be installed. Primary support 11253 couples to concrete structural member 11102 via insertion of a form attachment 11206*f* such as a screw, bolt or the like through the aperture 11284 in plate 11246*a* into the concrete structural member, or an insert placed therein, wherein the head of the screw, bolt, or the like is larger than the aperture, thereby holding plate 11246*a* in place.

Primary tie system 11298 is substantially identical to primary tie system 12298, as described with reference to FIG. 12B, however, it attaches on its upper end to form 11000 via a plate 11246*b* rather than a coil loop and eye bolt style form attachment. Plate 11246*b* is substantially identical to plate 11246*a* and it couples to form 11000 in the same manner with which plate 11246*a* couples to concrete structural member 11202, however the angle of the bend in plate 11246*b* may be adjusted to accommodate the angle of the primary tie system 11298.

Figure 11F:
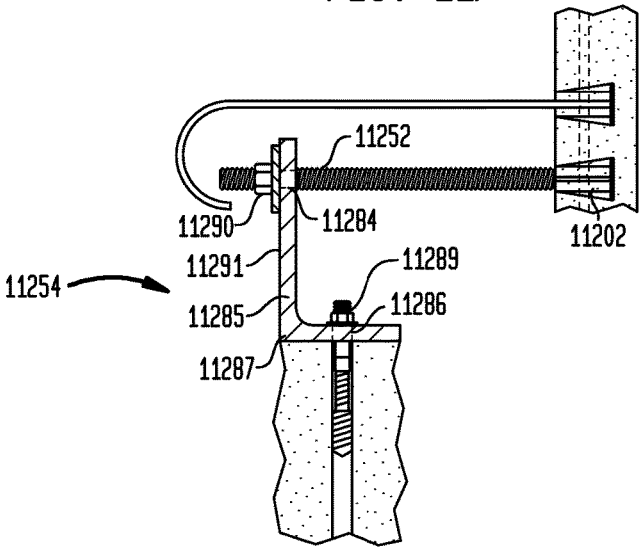
FIG. 11F depicts a side view of a secondary support for use with the form of FIG. 11A in accordance with one embodiment of the present invention.

Also, secondary supports 11254 differs from secondary support 1254 as shown in FIG. 11F. Secondary support 11254 is an L shaped bracket having a base aperture 11286 that is substantially centered in base 11287 and a wall aperture 11284 that is substantially horizontally centered in wall 11285 at an upper end thereof. As also seen in FIG. 11F, secondary support is coupled to a concrete structural member 11102, or an insert recessed therein, via a fastener or form attachment 11289 such as a bolt and washer or a screw. Secondary tie system 11252 is attached to form 11000 via passing a first end of rod 11252 through wall aperture 11284 (such that rod 11252 is substantially parallel to concrete structural member 11102), and then threading it into an insert 11202 recessed in form 11000 as shown in FIG. 11F. Inserts 11202 are similar to those described in greater detail hereinabove with regards to inserts 202. After such threading, secondary tie system 11252 is further coupled to secondary support 11254 via the threading of a secondary tie system fastener 11290 to a second end of secondary tie system 11252 until the fastener is in contact with an outwardly facing surface 11291 of wall 11285. Secondary tie system fastener may be, for example, a washer and a nut as shown in FIG. 11F.

After the form 11000 is installed as depicted in FIG. 11A, the process of installing the deck and barrier may proceed as described above with respect to FIGS. 3A through 3I with the following modifications. After the deck concrete is poured and cured, the portion of attachment mechanism 11060 located above the deck and which is not going to be encased in the barrier may optionally be removed from the form 11000 via dismantling adjustable fastener 11251 from upper plate 11246 on one end and rod insert 11250*a* on the opposite end. The rod insert 11250*a* and upper plate 11246 may need to be cut away from the newly formed deck by means of a grinder and the like. Alternatively, they may be left in place and encased in the overall deck and barrier combination. The encasement of form 11000 facilitates the ability of form 11000 to accommodate the shear and moment forces placed thereupon by the weight of the overall deck and barrier.

Further, when the concrete for the barrier is poured, it is poured to a height that is higher than the upwardly facing surface 11222 of form 11000, and is held in place by removable form 11508. In this manner, the barrier is poured over form 11000. After the concrete is cured, the removable form 11508 is then removed from the outwardly facing surface of form 11000.

Figure 12A:
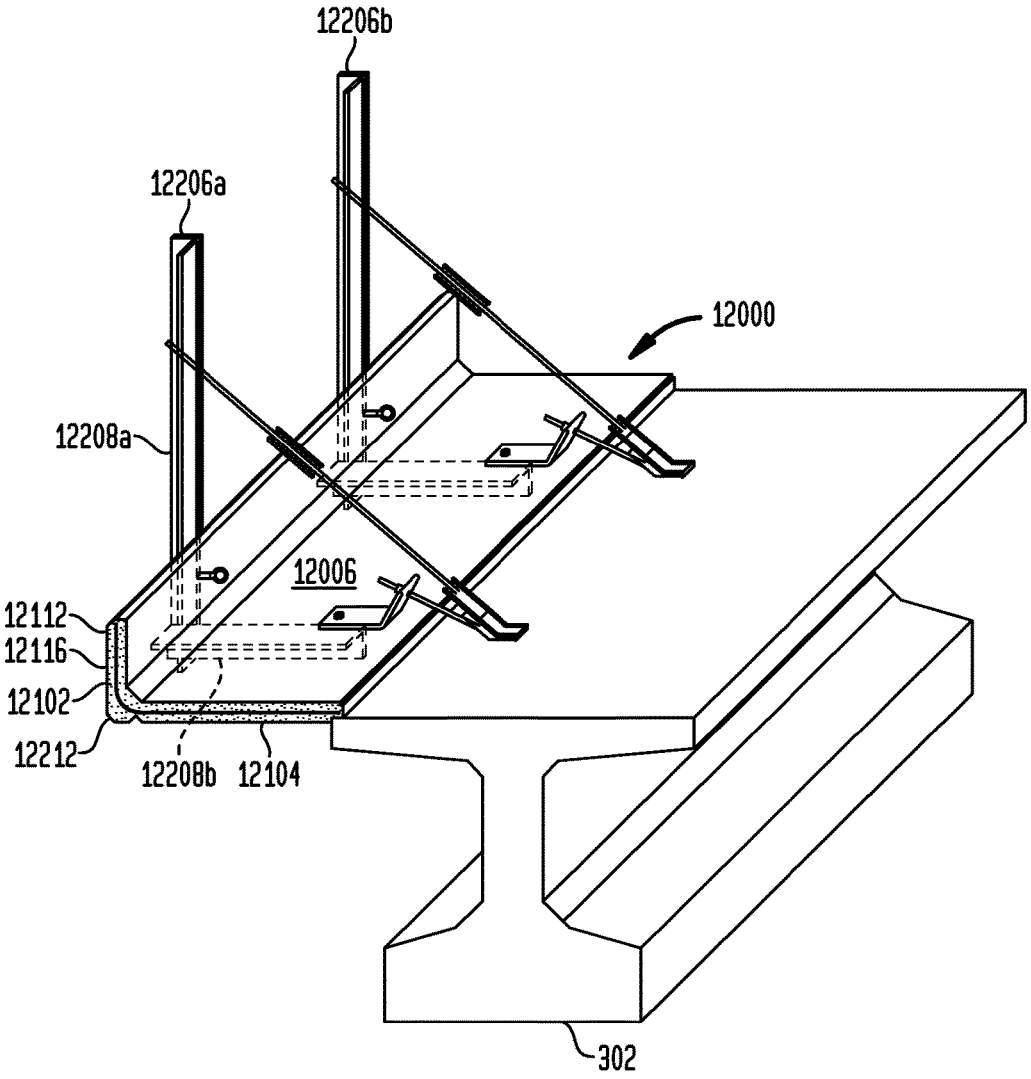
FIG. 12A depicts a perspective view of an alternate form atop a structural member in accordance with one embodiment of the present invention.
Figure 12B:
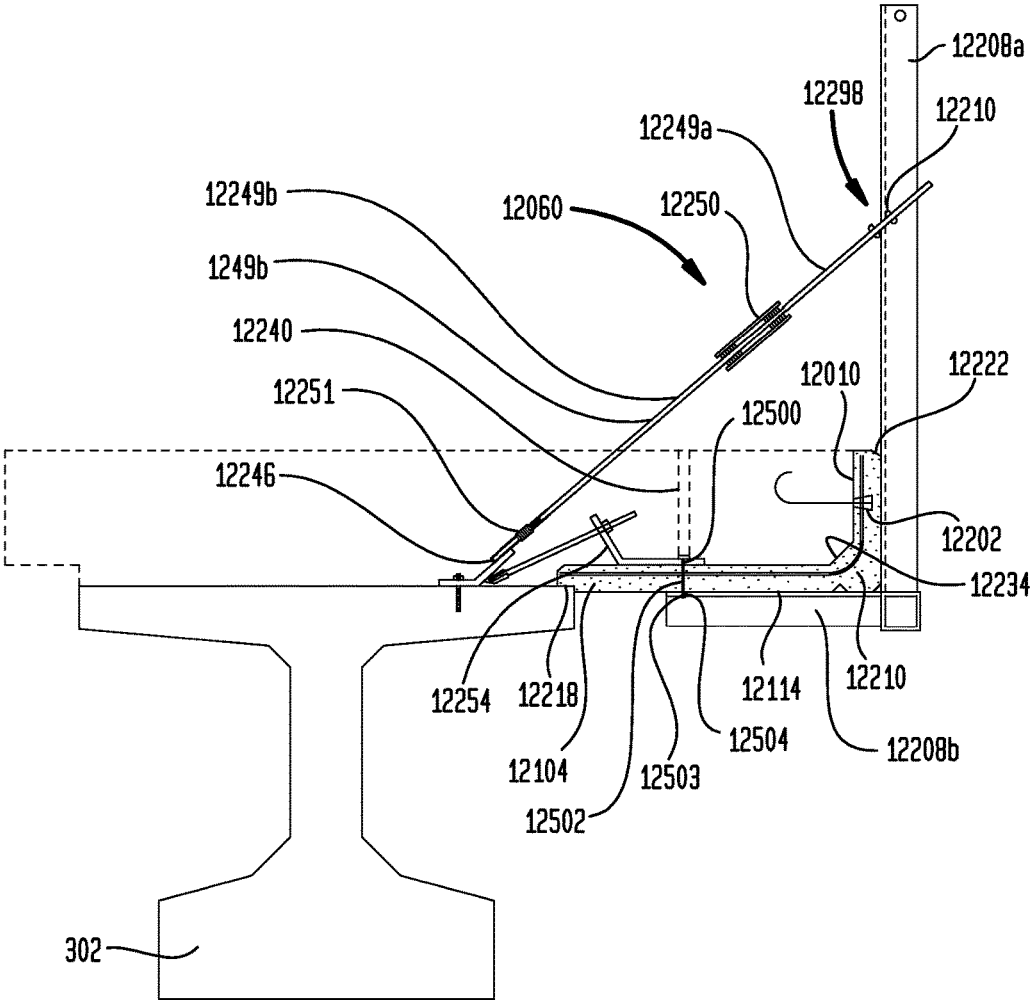
FIG. 12B depicts a side view of the alternate form of FIG. 12A mounted atop a structural member in accordance with one embodiment of the present invention.
Figure 12C:
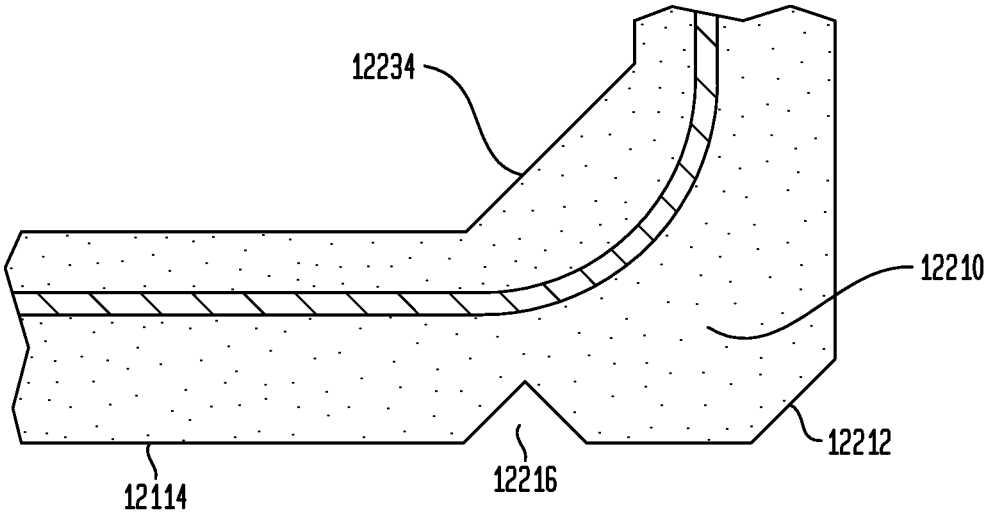
FIG. 12C depicts an enlarged side view of the intersection of the horizontal and vertical components of the form of FIG. 11A in accordance with one embodiment of the present invention.

Referring next to FIGS. 12A through 12C, depicted is yet another exemplary alternate stay-in-place form 12000 in accordance with an alternate embodiment of the present invention, the form mounted parallel to, and tied atop, a structural member 302 as discussed in greater detail above. This exemplary form 12000 is utilized as a form for supporting uncured concrete for a deck only (e.g., in an embodiment in which there is a steel railing with a sidewalk or safety walk in lieu of a concrete barrier), and, after the concrete has cured, form 12000 remains an integral part of the structure formed thereby. This exemplary form 12000 is intended for uses similar to the uses of forms 100, 1000, and 1100, and provides similar benefits to such forms, as described in greater detail above with the modifications described herein.

Similar to form 1000, form 12000 is a relatively thin, substantially L-shaped panel that includes a relatively short vertical component 12102 and a longer horizontal component 12104. In the depicted embodiment, vertical component 12102 is located substantially perpendicular to horizontal component 12104, however, alternate orientations may be substituted.

In the depicted embodiment, the features of form 12000 including, without limitation, insert 12202, form interior surface 12006, bevel 12212, vertical component upwardly facing surface 12222, vertical component inwardly facing surface 12010, joining component inwardly facing surface 12234, joining component 12210, horizontal component downwardly facing surface 12114, and rabbet 12218 are substantially identical to the equivalent components of form 1000, namely, insert 1202, form interior surface 1006, bevel 1212, vertical component upwardly facing surface 1222, vertical component inwardly facing surface 1010, joining component inwardly facing surface 1234, joining component 1210, horizontal component downwardly facing surface 1114, and rabbet 1218 as discussed above with the following exceptions.

In the depicted embodiment, form 12000 is mounted parallel to, and tied atop, structural member 302. As shown in FIG. 12A, form 12000 is supported by at least one pair of L-shaped brackets 12206*a* and 12206*b*. Each bracket 12206 is formed from a pair of bracket sections 12208*a* and 12208*b*, which may be made of a rigid material such as steel or the like. Second bracket section 12208*b* is oriented perpendicular to the vertical axis of structural member 302. First bracket section 12208*a* is disposed vertically at the distal end of second bracket section 12208*b*, and its bottommost end is welded to the distal end of second bracket section 12208*b* such that the first and second bracket sections together form a substantially ninety (90) degree angle cradle capable of holding form 12000 in place thereupon. In the depicted embodiment, the angle is ninety (90) degrees, however alternate angles may be substituted without departing from the scope hereof. Also, varying quantities of brackets and bracket sections, as well as brackets having differing configurations, may be substituted without departing form the scope hereof.

Brackets 12206 are connected to structural member 302 and form 12000 via attachment mechanism 12060. In the depicted embodiment, attachment mechanism 12060 is substantially identical to attachment mechanism 1060 as described above with the exception of the primary tie system 12298. As best seen in FIG. 12B, primary tie system 12298 includes two threaded rods 12249*a* and 12249*b* (e.g., inline, Dayton Superior threaded metal rods having a ¾-inch diameter capable of withstanding a load of at least 18,000 lbs), which are coupled to substantially vertical first bracket section 12208*a* and structural member 302 in a diagonal fashion.

A first rod 12249*a* has a first threaded end that is connected to apertures in substantially vertical first bracket section 12208*a* by means of fastener 12210. In the depicted embodiment, fastener 12210 is a washer and coil nut, however, alternate fasteners may be substituted without departing from the scope hereof A second end of first rod 12249*a* is connected to a first end of second rod 12249*b* via an adjustable fastener 12250. In the depicted embodiment, adjustable fastener 12250 is a cylinder-shaped, strut coil tie with a ¾-inch diameter and six-inch length. Adjustable fastener 12250 allows the spacing between rods 12249*a* and 12249*b* to be adjusted via rotation of adjustable fastener 12250 in either of two directions, typically via a wrench. The adjustable fastener facilitates placing the form 12000 in a substantially plumb position. A second end of second rod 12249*b* is coupled to a coil loop 12251, which is welded to upper plate 12246 in the same manner discussed above with respect to upper plate 1246 as shown in FIG. 10B.

Another difference in the form 12000 as compared to form 1000 is that the horizontal component 12104 includes horizontal component apertures 12502 in lieu of inserts 1202*c*. These apertures 12500 allow secondary support 12254 to be coupled to horizontal member 12104 and second bracket section 12208*b* via passage of a fastener 12503 (e.g., a bolt with a washer) through secondary support aperture 12500, horizontal component aperture 12502, and second bracket section aperture 12504 to connect all three components to each other, sandwiching form 12000 between secondary support 12254 and second bracket section 12208*b*. In some embodiments, the fastener 12502 is configured to receive a hollow plastic sleeve 12240 to create a small tunnel to allow access to the fastener 12503 after the poured deck cures.

Additionally, as seen in FIG. 12C, another variation of form 12000 is that a channel 12216 is substituted in lieu of a protrusion 216 as discussed above with respect to form 100. As best seen in FIG. 12C, channel 12216 is recessed longitudinally along the length of form 12000 directly below joining component 12234. Channel 12216 has a substantially triangular cross-section, with both internal sides oriented at an angle of forty five (45) degrees relative to the vertical midpoint of the channel. Channel 12216 acts as a drip strip to cause water to drip downward rather than along downwardly facing surface 12114. Channel 12216 and bevel 12212 both act to eliminate or minimize the amount of water that reaches structural support 302 in an effort to minimize corrosion thereof. However, alternate configurations, locations, and/or shapes for this channel may be substituted, or channel 12216 may be omitted, without departing from the scope hereof.

After the form 12000 is installed as depicted in FIGS. 12A and 12B, the process of installing the deck may proceed as described above with respect to FIGS. 3A through 3I (except that no barrier is poured). After the deck concrete is poured and cured, the portion of attachment mechanism 12060 located above the deck and which is not going to be encased in the deck may be removed from the form 12000 via dismantling adjustable fastener 12250 from its adjacent rods 12249*a* and 12249*b*. The rods 12249*a* and/or 12249*b* may need to be cut away from the newly formed deck by means of a grinder and the like. Additionally, the brackets 12206 are removed from form 12000, the latter remaining in place internal to the poured deck. The encasement of form 12000 in the poured deck facilitates the ability of form 12000 to accommodate the shear and moment forces placed thereupon by the weight of the overall deck.

Turning now to FIGS. 13A through 13F, depicted is an exemplary alternate stay-in-place fascia form 13000 in accordance with one alternate embodiment of the present invention, the form mounted parallel to, and tied atop, structural member 302. This exemplary form 13000 is utilized as a form for supporting uncured concrete, and, after the concrete has cured, form 13000 remains an integral part of the structure formed thereby. This exemplary form 13000 is intended for uses similar to the uses of the other forms discussed herein, and provides similar benefits to such forms, as described in greater detail above.

Similar to form 100, form 13000 is a relatively thin, substantially L-shaped panel that includes vertical component 13002 and horizontal component 13004. In the depicted embodiment, vertical component 13002 is located substantially perpendicular to horizontal component 13004, however, alternate orientations may be substituted.

Vertical component 13002 and the proximal portion of horizontal component 13004 have thicknesses similar to the thicknesses of form 1000 as discussed in greater detail above. The height $H_{13}$ and width $W_{13}$ of form 13000 is approximately forty eight inches (48"), and the length $L_{13}$ is approximately sixty inches (60"), however, varied dimensions may be substituted to accommodate, for example, desired size of the structure being built as well as material strength and geometric boundaries.

In the depicted embodiment, the features of form 13000 including, without limitation, insert 13202, form attachment 13206, form interior surface 13006, bevel 13212, vertical component upwardly facing surface 13222, vertical component inwardly facing surface 13010, joining component inwardly facing surface 13234, joining component 13210, horizontal component downwardly facing surface 13114, and rabbet 13218 are substantially identical to the equivalent components of form 1000, namely, insert 1202, form attachment 1206, form interior surface 1006, bevel 1212, vertical component upwardly facing surface 1222, vertical component inwardly facing surface 1010, joining component inwardly facing surface 1234, joining component 1210, horizontal component downwardly facing surface 1114, and rabbet 1218 as discussed above with the exceptions of the attachment mechanism 13060.

Figure 13A:
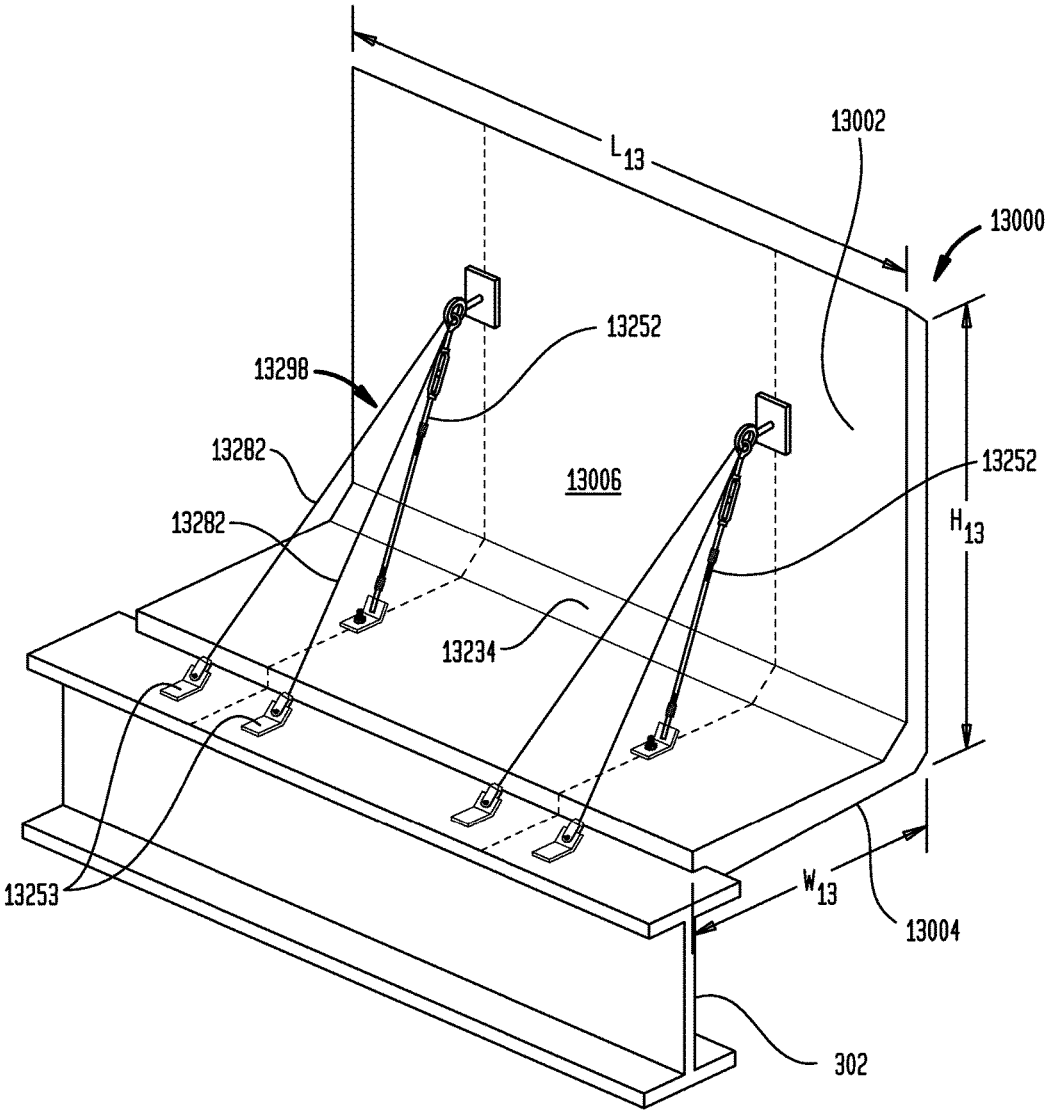
FIG. 13A depicts a perspective view of an alternate form atop a structural member in accordance with one embodiment of the present invention.
Figure 13B:
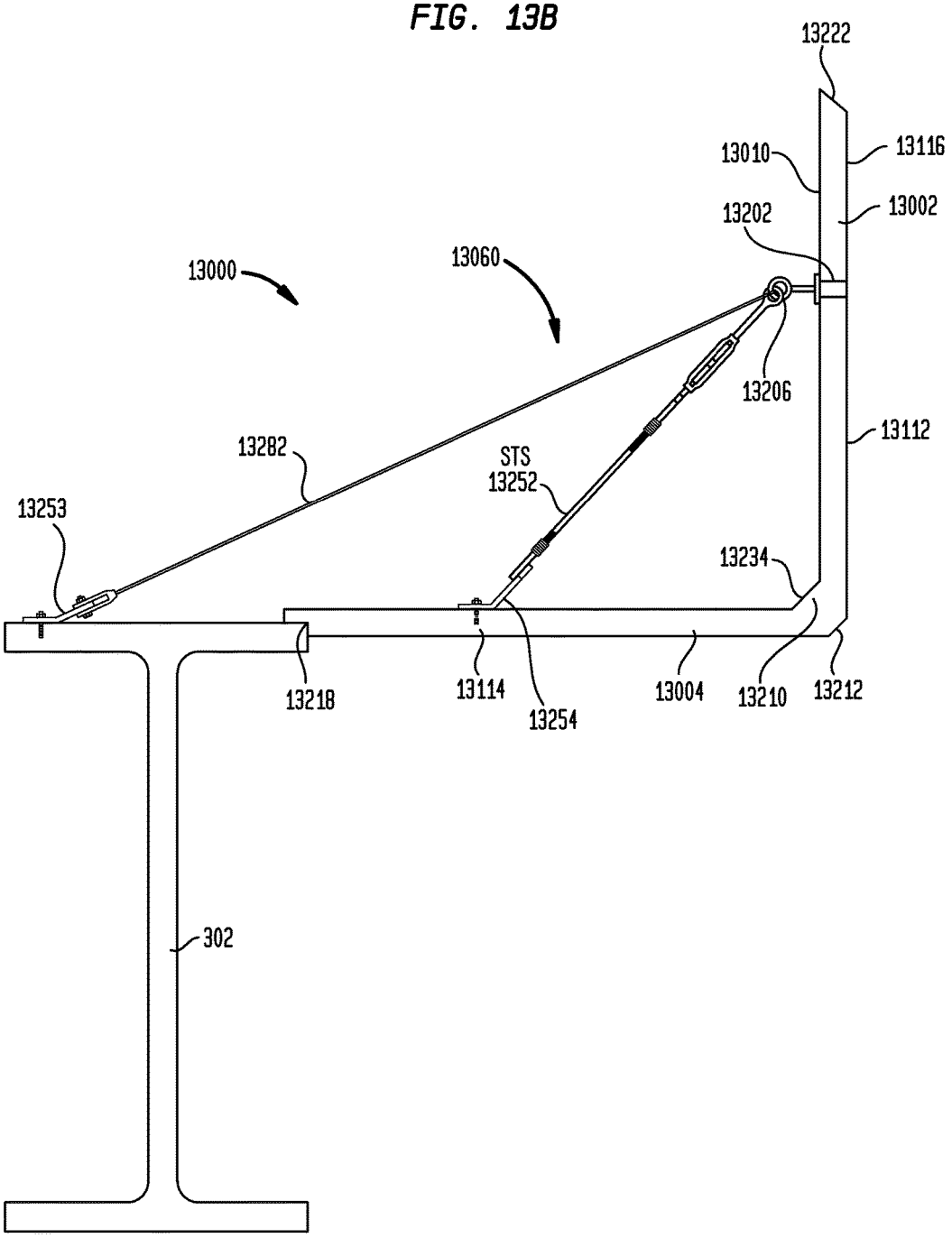
FIG. 13B depicts a side view of the alternate form of FIG. 13A mounted atop a structural member in accordance with one embodiment of the present invention.
Figure 13C:
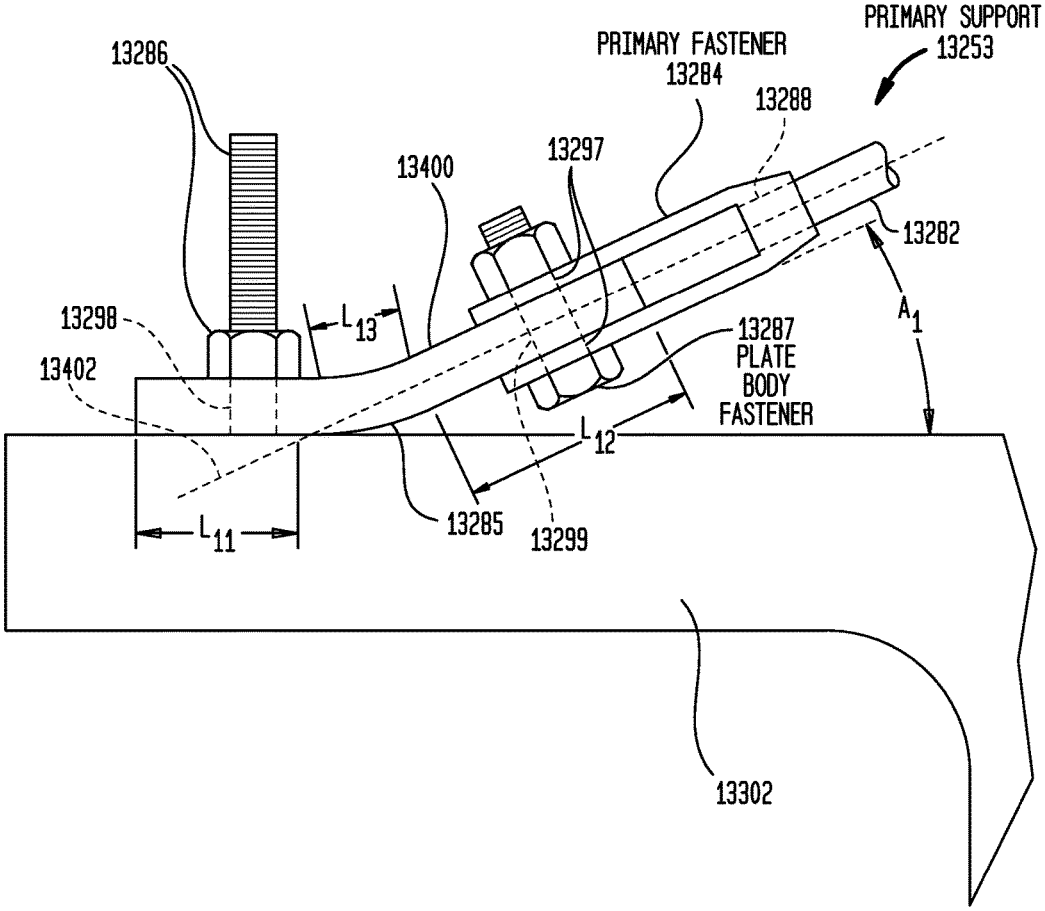
FIG. 13C depicts a side view of a primary support for use with forms including, but not limited to, the form of FIG. 13A in accordance with one embodiment of the present invention.

The attachment mechanism 13060 depicted in FIGS. 13A-13C may be used, for example, with large forms that have large overhangs relative to structural member 302 due to factors including, but not limited to, the size of horizontal component 13004. In the depicted embodiment, attachment mechanism 13060 incorporates a strut style secondary tie system 13252 to help reduce and distribute the stress placed on the form 13000.

As depicted in FIGS. 13A and 13B, each form 13000 incorporates a pair of attachment mechanisms 13060 for coupling form 13000 to structural member 302. Further, each attachment mechanism 13060 includes primary support 13253, secondary support 13254, primary tie system 13298, and secondary tie system 13252. Primary tie system 13298 includes a pair of threaded tie back rods 13282 installed diagonally, made of a rigid material such as steel, and sized for a load of, for example, at least 95,000 lbs. A first end of primary tie system 13298 is coupled to form 13000 via insert 13202 and a form attachment 13206 such as an eyebolt, anchor rod or the like. Insert 13202 and form attachment 13206 at a point above the vertical midpoint of vertical component 13002. A second end of primary tie system 13298 is attached to structural support 302 via a pair of primary supports 13253.

In the depicted embodiment, primary support 13253 includes a primary fastener 13284, plate 13285, plate body fastener 13287, and plate base fastener 13286. As shown in FIG. 13C, the second end of each primary support 13253 is coupled to a respective primary fastener 13284. In the depicted embodiment, primary fastener 13284 is a clevis constructed of a one half (½) inch rigid material such as Grade 50 steel and the like with an aperture 13297 having a diameter of seven eights (⅞) inch. The primary fastener 13284 has a threaded aperture 13288 for engaging the threaded end of the respective tie back rod 13282. The tie back rod 13282 and primary fastener 13284 connect to existing structural member 302 by means of a rectangular, bent plate 13285 with a length of nine and one quarter (9¼) inches, a width of four (4) inches, and a thickness of one half (½) inch. However, the dimensions of plate 13285 may vary depending upon, for example, the governmental standard being met (e.g., OSHA 4:1 Failure (ULT), AASHTO ASD and 2:1 (ULT), AISC ASD AND 2:1 (ULT)). Plate 13285 is made of a rigid material such as Grade 50 steel and the like and has base and body apertures 13298 and 13299, respectively. In the depicted embodiment, the body 13400 of plate 13285 is bent at an angle $A_1$ of approximately twenty-five (25) degrees relative to the longitudinal axis of body 13400 of plate 13285. Also, base 13402 has a length $L_{11}$ of approximately three and one quarter (3¼) inches, and the body 13400 has a length $L_{12}$ of approximately four and a quarter (4¼) inches with a bend length $L_{13}$ of approximately one and three quarters (1¾) inch, however, alternate angles, lengths, and/or other dimensions may be substituted to accommodate, for example, varying sizes of forms.

Plate 13285 is coupled to structural member 302 via sliding base aperture 13298 of plate 13285 over a seven-eighths (⅞) inch threaded shear stud welded to the structural member 302. A nut is then threaded over the stud until it contacts the upwardly facing surface of the base of plate 13285 in order to secure the plate 13285 to the structural member 302.

Also, the clevis 13284 is slid over the body of plate 13285 until its apertures 13297 align with body aperture 13299 of plate 13285. Thereafter, fastener 13287 is passed therethrough to couple primary fastener 13284 and the coupled primary support to plate 13285. In this manner, each tie back rod 13282 is coupled to structural member 302. Fastener 13287 is in the form of a clevis bolt and respective nut, however, alternate fasteners may be substituted.

Thereafter, or prior to such attachment, secondary tie system 13252 may be installed. In the depicted embodiment, secondary tie system includes a strut such as an interior angle strut, which may be installed via a form attachment coupled to an insert as described in greater detail herein. Or, in some instances, screws or the like may be drilled directly into form 13000.

Figure 13D:
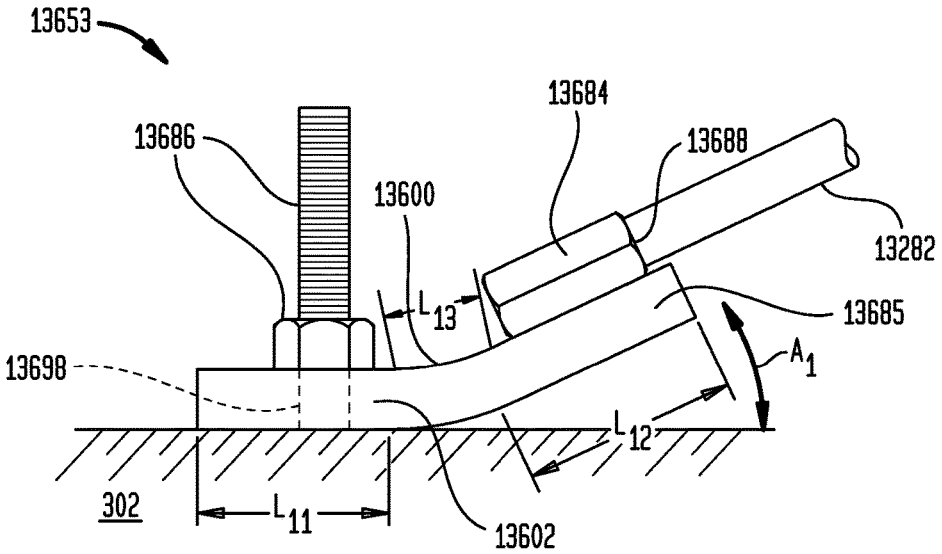
FIG. 13D depicts a side view of an alternate primary support for use with forms including, but not limited to, the form of FIG. 13A in accordance with one embodiment of the present invention.

Turning now to FIG. 13D, depicted is an alternate primary support 13653, which includes a primary fastener 13684, plate 13685, and plate base fastener 13686. As shown in FIG. 13D, the second end of each primary support 13653 is coupled to a respective primary fastener 13684. In the depicted embodiment, primary fastener 13684 is a seven-eighths inch (⅞") diameter by two and one half inches (2½") long coupler nut which is welded to plate 13685. The primary fastener 13684 has a threaded aperture 13688 for engaging the threaded end of the respective tie back rod 13282. Fastener 13684 is in the form of a coupler nut welded to plate 13685, however, alternate fasteners may be substituted.

The tie back rod 13282 and primary fastener 13684 connect to existing structural member 302 by means of a rectangular, bent plate 13685 with a length of nine and one quarter (9¼) inches, a width ranging from three inches (3") to four and three quarters inches (4¾"), and a thickness of one (1) inch. However, the dimensions of plate 13685 may vary depending upon, for example, the governmental standard being met (e.g., OSHA 4:1 Failure (ULT), AASHTO ASD and 2:1 (ULT), AISC ASD AND 2:1 (ULT)). The plate 13685 is made of a rigid material such as Grade 50 steel and the like and has base aperture 13698. In the depicted embodiment, the body 13600 of plate 13685 is bent at an angle $A_1$ of approximately twenty-five (25) degrees relative to the longitudinal axis of base 13602 of plate 13685. Also, base 13602 has a length $L_{11}$ of approximately three and three eighths (3⅜) inches, and the body 13600 has a length $L_{12}$ of approximately three and one sixteenth (3 1/16) inches with a bend length $L_{13}$ of approximately one and three quarters (1¾) inch, however, alternate angles, lengths, and/or other dimensions may be substituted to accommodate, for example, varying sizes of forms.

Plate 13685 is coupled to structural member 302 via sliding base aperture 13698 of plate 13685 over a seven-eighths (⅞) inch threaded shear stud welded to the structural member 302. A nut is then threaded over the stud until it contacts the upwardly facing surface of the base of plate 13685 in order to secure the plate to the structural member 302.

It should be noted that although FIG. 13D depicts a single plate 13685 with a first angle $A_1$, it is envisioned that multiple plates could be stacked and each plate could have varying dimensions and/or angles to allow each of the plates to be coupled to respective tie back rods or the like similar to the stacked plates shown in FIG. 10B, as discussed above, but having the features of fastener 13653.

Figure 13E:
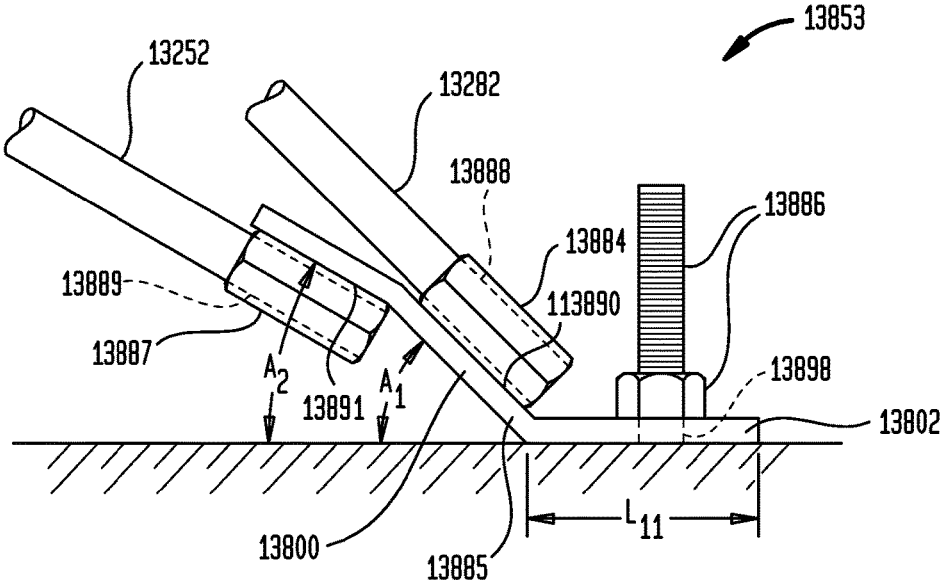
FIG. 13E depicts a side view of another alternate primary support for use with forms including, but not limited to, the form of FIG. 13A in accordance with one embodiment of the present invention.

Referring now to FIG. 13E, depicted is an alternate primary support 13853, which includes a primary fastener 13884, plate 13885, secondary fastener 13887, and plate base fastener 13886. As shown in FIG. 13D, the second end of each primary support 13853 is coupled to a respective primary fastener 13884 and secondary fastener 13887. In the depicted embodiment, primary fastener 13884 and secondary fastener 13887 are seven-eighths inch (⅞") diameter by two and one half inches (2½") long coupler nuts which are welded to plate 13885. The primary fastener 13684 has a threaded aperture 13888 for engaging the threaded end of a primary tie back rod 13282, and the secondary fastener 13887 has a threaded aperture 13889 for engaging the threaded end of a secondary tie back rod 13252. Although fasteners 13884 and 13887 are in the form of welded coupler nuts, alternate fasteners may be substituted.

The tie back rod 13282/primary fastener 13884 and the tie back rod 13252/secondary fastener 13887 connect to existing structural member 302 by means of a rectangular, bent plate 13885 with a length of approximately thirteen (13) inches, a width ranging from three inches (3") to four and three quarters inches (4¾"), and a thickness of one (1) inch. However, the dimensions of plate 13885 may vary depending upon, for example, the governmental standard being met (e.g., OSHA 4:1 Failure (ULT), AASHTO ASD and 2:1 (ULT), AISC ASD AND 2:1 (ULT)). The plate 13685 is made of a rigid material such as Grade 50 steel and the like and has base aperture 13898. In the depicted embodiment, the body 13800 of plate 13885 is bent at two angles A1 and A2. Angle $A_1$ is approximately forty-five (45) degrees relative to the longitudinal axis of base 13802 of plate 13885, and angle $A_2$ is approximately twenty-five (25) degrees relative to the longitudinal axis of body 13800 of plate 13885. As depicted in FIG. 13E, primary fastener 13884 is welded to the upwardly facing surface 13890 of the body 13800 and secondary fastener 13887 is welded to the downwardly facing surface 13891 of the distal end of plate 13885. However, alternate angles, lengths, and/or other dimensions may be substituted to accommodate, for example, varying sizes of forms.

Plate 13885 is coupled to structural member 302 via sliding base aperture 13898 of plate 13885 over a seven-eighths (⅞) inch threaded shear stud welded to the structural member 302. A nut is then threaded over the stud until it contacts the upwardly facing surface of the base of plate 13885 in order to secure the plate to the structural member 13302.

Further, alternate attachment mechanisms 13060 may be substituted without departing from the scope hereof. Or, alternate components of the attachment mechanism 13060 including, but not limited to, primary support 13253, secondary support 13254, primary tie system 13298, and secondary tie system 13252 may be substituted without departing from the scope hereof.

Figure 13F:
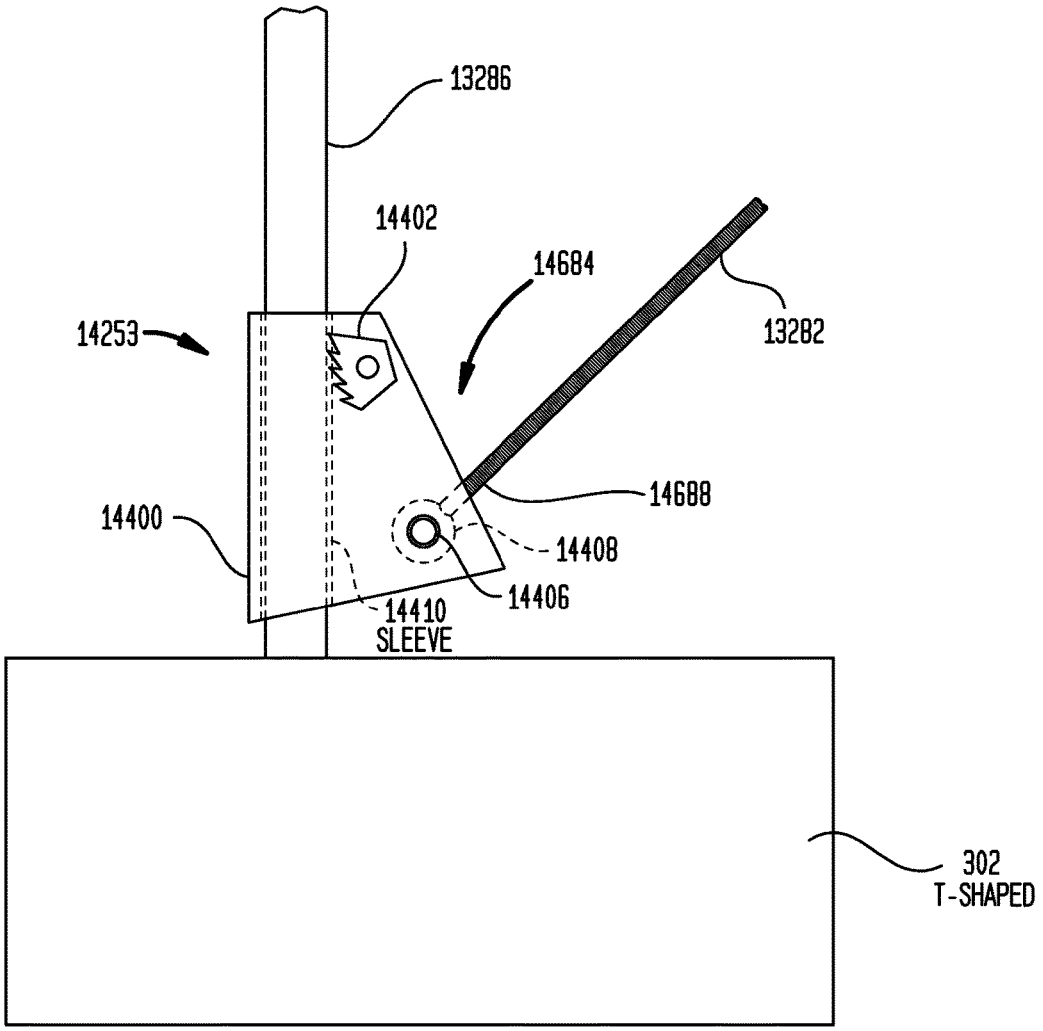
FIG. 13F depicts a side view of an alternate primary support for use with forms including, but not limited to, the form of FIG. 13A in accordance with one embodiment of the present invention.

Turning now to FIG. 13F, depicted is an alternate primary support 14253, which includes a primary fastener 14684, plate 14400, tie system fastener 14406, and plate fastener 14402. This type of support may be used, for example, when a vertical support is available (e.g., rebar or a shear stud) to which the plate 14400 may be attached.

As shown in FIG. 13F, in the depicted embodiment, primary fastener 14684 includes a tie system fastener 14406 that includes a bolt and nut combination. Eyebolt 14408 includes a threaded aperture 14688 in a first end for engaging the threaded end of the respective tie back rod 13282. Eyebolt 14408 is held to plate 14400 via tie system fastener 14406, the bolt of which passes through the head of the eyebolt 14408 and corresponding apertures in the plate 14400. The bolt is held in place via the tightening of the nut on the end of the bolt external to plate 14400. However, tie back rod 13282 may be coupled to plate 14400 via alternate fasteners without departing from the scope of the present invention.

Primary support 14253 connects to a vertical support 13286 coupled to the structural member 302 by means of a cam-locking U-shaped bracket 14400. That is, the U-shaped plate includes a bite bit cam 14402 that bites into the vertical support 13286 when the plate and its associated cam are rotated relative to vertical support to create a clamping force on the vertical support. This clamping force prevents or minimizes movement of plate 14253 relative to vertical support 13286.

In an alternative embodiment, primary support 14253 is rotated one hundred and eighty degrees prior to attachment to the vertical support. And, optionally, a sleeve 14410 may be included within plate 14400 to further prevent or minimize movement of plate 14253 relative to vertical support 13286. Alternate embodiments are also envisioned in which one or more bolt and nut (and optionally washer) combinations are utilized to squeeze the U shaped plate around the vertical support. In any of the above described embodiments, embodiments are also envisioned in which the primary support 14253 is allowed to ride up (i.e., move vertically) the vertical support until a head or other interference limits movement thereof.

In embodiments of the present invention utilizing primary supports such as primary support 14253, the primary support is typically coupled to the vertical support prior to installation of the corresponding form. Next, the form, which has the tie rods pre-installed on it, is lifted into place. Next, the tie rods are coupled to primary support 14253. Although other sequences can be substituted. For example, the primary support 14253 could be installed at the same time the form is lifted into place and/or the tie rods could be installed after the form is lifted into place.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. We claim a form for creation of a structure, the form for supporting uncured concrete prior to curing comprising:

a substantially vertical component, the substantially vertical component having a substantially vertical inwardly facing surface and a substantially vertical outwardly facing surface;

a substantially horizontal component having a substantially horizontal inwardly facing surface and a substantially horizontal outwardly facing surface, the substantially vertical component located substantially perpendicular to the substantially horizontal component and extending upwardly from the horizontal component, the substantially vertical component and the substantially horizontal component forming an L shape;

at least one threaded insert in or through at least one of the group consisting of the substantially vertical inwardly facing surface, the substantially horizontally inwardly facing surface, and combinations thereof;

a rabbet extending longitudinally along the substantially horizontal component, the rabbet recessed in the substantially horizontal outwardly facing surface at the distal end thereof, the rabbet defined by top and side surfaces, the side surface being substantially vertical, and the top surface located at a angle of greater than ninety degrees relative to the side surface, the top surface tapered upwardly as it extends away from the side surface.

2. A form according to claim 1, further comprising:

at least one form attachment configured for mating with the at least one insert.

3. A form according to claim 2, wherein the at least one form attachment is an exterior reinforcement.

4. A form according to claim 1, further compromising an interconnection clip.

5. A form according to claim 1, further comprising:

at least one of the group consisting of an interior reinforcement, an ornamental feature, and combinations thereof.

6. A form according to claim 1, wherein a thickness of the substantially horizontal component and the substantially vertical component is approximately two inches.

7. A form according to claim 1, wherein an upwardly facing surface of the substantially vertical component inclines upwardly and inwardly toward the substantially vertical inwardly facing surface at an angle of approximately thirty degrees.

8. A form according to claim 1, further comprising:

a joining component.

9. A form according to claim 8, wherein the joining component extends at an angle of 45 degrees relative to the substantially vertical inwardly facing surface and the substantially horizontal inwardly facing surface.

10. A form according to claim 1, wherein an upper corner of a distal end of the substantially horizontal component is rounded.

11. A form according to claim 1, further comprising:

a protrusion extending longitudinally from the substantially horizontal outwardly facing surface.

12. A form according to claim 11, wherein the protrusion has a semicircular cross section.

13. A form according to claim 11, wherein the protrusion is located at the approximate midpoint of a proximal half of the substantially horizontal component.

14. A form according to claim 1, wherein the rabbet is substantially L-shaped.

15. We claim a form for creation of a structure, the form for supporting uncured concrete prior to curing comprising:

a substantially vertical component, the substantially vertical component having a substantially vertical inwardly facing surface and a substantially vertical outwardly facing surface;

a substantially horizontal component having a substantially horizontal inwardly facing surface and a substantially horizontal outwardly facing surface, the substantially vertical component located substantially perpendicular to the substantially horizontal component and extending upwardly from the horizontal component, the substantially vertical component and the substantially horizontal component forming an L shape;

at least one threaded insert in or through at least one of the group consisting of the substantially vertical inwardly facing surface, the substantially horizontally inwardly facing surface, and combinations thereof;

a rabbet extending longitudinally along the substantially horizontal component, the rabbet recessed in the substantially horizontal outwardly facing surface at a distal end thereof; and a bevel extending longitudinally along the intersection of the substantially vertical outwardly facing surface and the substantially horizontal outwardly facing surface.

16. A form according to claim 15, wherein the bevel is located at an angle of 45 degrees relative to the substantially vertical outwardly facing surface and the substantially horizontal outwardly facing surface.

17. A form according to claim 15, wherein an upper corner of a distal end of the substantially horizontal component is rounded.

18. A form according to claim 15, further comprising:

a protrusion extending longitudinally from the substantially horizontal outwardly facing surface.

19. A form according to claim 18, wherein the protrusion has a semicircular cross section.

20. A form according to claim 18, wherein the protrusion is located at the approximate midpoint of a proximal half of the substantially horizontal component.

* * * * *